US005799576A

United States Patent [19]

Koike et al.

[11] Patent Number: 5,799,576

[45] Date of Patent: Sep. 1, 1998

[54] ROTARY STAMP

[76] Inventors: Hiroyuki Koike, 24-32, Nishitoriishi 1-chome, Takaishi-shi, Osaka 592; Toshinori Sugiyama, 5-26, Takaminosato 1-chome, Matsubara-shi, Osaka 580, both of Japan

[21] Appl. No.: 786,311

[22] Filed: Jan. 21, 1997

[30] Foreign Application Priority Data

Jan. 25, 1996 [JP] Japan ..... 8-032919
Nov. 29, 1996 [JP] Japan ..... 8-318387

[51] Int. Cl.[6] ..... B41J 1/60

[52] U.S. Cl. ..... 101/111; 101/109

[58] Field of Search ..... 101/111, 109, 101/105, 103

[56] References Cited

U.S. PATENT DOCUMENTS

| | | | |
|---|---|---|---|
| 1,556,782 | 10/1925 | Glasgow | 101/110 |
| 1,677,319 | 7/1928 | Andersen | 101/111 |
| 2,096,340 | 11/1937 | Richeson | 101/111 |
| 2,109,342 | 2/1938 | Rebl | 101/103 |
| 3,977,321 | 8/1976 | Pabodie | 101/111 |
| 4,327,640 | 5/1982 | Hamisch | 101/110 |
| 4,337,698 | 7/1982 | Jenkins | 101/105 |

FOREIGN PATENT DOCUMENTS

| | | | |
|---|---|---|---|
| 2 504 455 | 10/1982 | France . | |
| 58330 | 1/1891 | Germany . | |
| 847 904 | 8/1952 | Germany . | |
| 2242 679 | 8/1972 | Germany . | |
| 57-38182 | 3/1982 | Japan | 101/111 |
| 3-62866 | 6/1991 | Japan . | |
| 5-60863 | 8/1993 | Japan . | |
| 290318 | 4/1953 | Switzerland . | |

*Primary Examiner*—Edgar S. Burr
*Assistant Examiner*—Anthony H. Nguyen
*Attorney, Agent, or Firm*—Nikaido, Marmelstein, Murray & Oram LLP

[57] ABSTRACT

Endless printing belts with plural types of printing areas arranged on outer surfaces thereof are wound around printing support shafts and printing rotation members. Display rotation mechanisms have, arranged on outer surfaces thereof, display characters corresponding to printing characters in the printing areas arranged on the outer surfaces of the printing belts. A control member applies a torque to each printing rotation member or display rotation mechanism whereby the printing rotation member and display rotation mechanism rotate synchronously. As a result, printing surfaces of the printing areas are successively set to a printing position adjacent the printing support shaft, and display characters corresponding to the printing characters in the printing areas set to the printing position are successively set to a display position. The user may observe the display characters successively appearing in the display position to set display characters corresponding to desired printing characters. Then, the printing surfaces of the printing characters corresponding to the display characters are set to the printing position.

18 Claims, 18 Drawing Sheets

Fig.18A
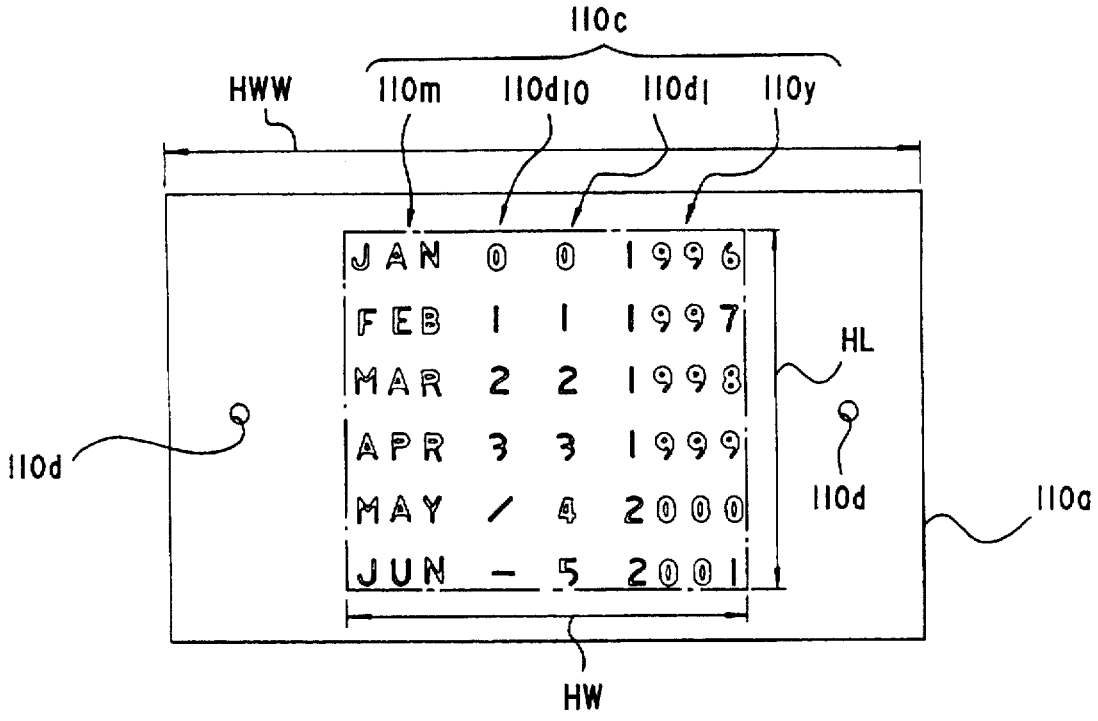
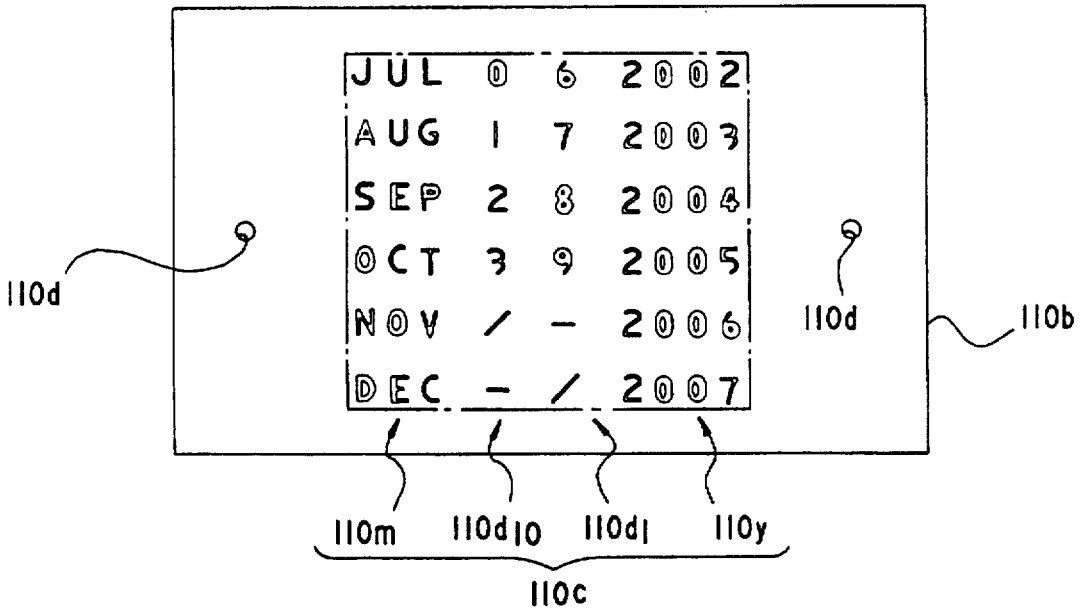
Fig.18B

Fig.19A
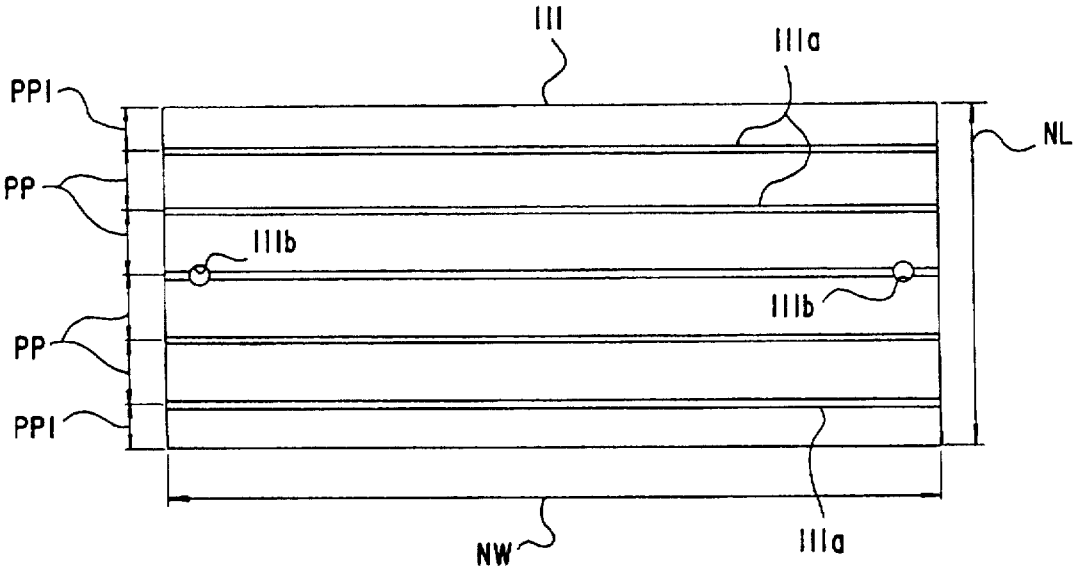
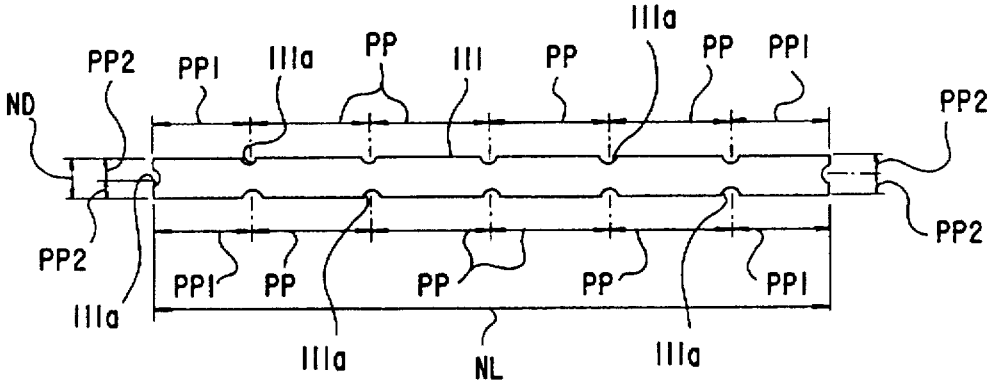
Fig.19B

ROTARY STAMP

BACKGROUND OF THE INVENTION (1) Field of the Invention

This invention relates to a rotary stamp including rotatable endless printing belts having plural types of printing areas arranged on outer surfaces thereof, in which printing surfaces of desired printing areas are set to a printing position.

(2) Description of the Related Art

A conventional stamp of this type includes a plurality of endless printing belts wound around rotatable elements and support shafts and having printing areas arranged on outer surfaces thereof. The printing areas have, for example, raised typefaces of numerals 0 to 9 for printing dates and numbers, and characters representing accounting subjects or the like. The user operates outer edges of turn disks connected to the rotatable elements of the printing belts to adjust the dates, accounting subjects or the like. In this way, the printing surface of a desired printing area is selected and set to a printing position of the stamp.

The printing belts used in the conventional rotary stamp are obtained as follows.

First, as shown in FIG. 1A, a forming die 302 for forming the printing areas arranged on the outer surfaces of the printing belts is set in a recess 301 of a base block 300 having a heater not shown mounted therein. A sheet-like rubber plate 303 is placed on the die 302 to act as a base material for the printing belts and printing areas. Further, a foundation 304 is placed on the rubber plate 303. The forming die 302 defines recesses in a surface thereof for forming the printing areas on the outer surfaces of the printing belts. As shown in FIG. 2A, for example, these forming recesses include recesses 302*m* for forming printing areas of the month, recesses 302$d_{10}$ for forming printing areas of the upper digit (second digit) of the day, recesses 302$d_1$ for forming printing areas of the lower digit (first digit) of the day, and recesses 302*y* for forming printing areas of the year. The forming die 302 is set in the recess 301 of the base block 300, with the surface defining the recesses 302*m*, 302$d_{10}$, 302$d_1$ and 302*y* facing up. A presser 305 having a heater not shown mounted therein stands by above the recess 301 of the base block 300.

Next, while the base block 300 and presser 305 are heated by the respective heaters, the pressure 305, as shown in FIG. 1B, presses the rubber plate 303 and foundation 304 upon the forming die 302. The heating and pressing are continued for a predetermined time. Then the rubber plate 303 melts and flows into the recesses 302*m*, 302$d_{10}$, 302$d_1$ and 302*y* to be integrated with the foundation 304. The sheet-like product thereby obtained is cut at peripheries thereof to become a rectangle. As shown in FIG. 2B, a sheet 310 integrated with the foundation 204 and corresponding to developed belts is formed, which defines raised typefaces in printing areas M (i.e. printing areas My for the year, printing areas $Md_1$ for the lower digit of the day, printing areas $Md_{10}$ for the upper digit of the day, and printing areas Mm for the moon).

Next, as shown in FIG. 1C, opposite ends 310*a* and 310*b* of this sheet 310 are placed one upon the other on a mandrel 306. The superposed parts are pressed upon the mandrel 306 by the heated presser 305, whereby the superposed parts are joined together. As a result, a web 320 is formed which, as shown in FIG. 3, combines a printing belt 320*y* having printing areas My for the year arranged on an outer surface thereof, a printing belt 320$d_1$ having printing areas $Md_1$ for the lower digit of the day arranged on an outer surface thereof, a printing belt 320$d_{10}$ having printing areas $Md_{10}$ for the upper digit of the day arranged on an outer surface thereof, and a printing belt 320*m* having printing areas Mm for the moon arranged on an outer surface thereof. This web 320 is cut and separated along dot-and-dash lines in FIG. 3 to obtain the printing belt 320*y* for the year, printing belt 320$d_1$ for the lower digit of the day, printing belt 320$d_{10}$ for the upper digit of the day, and printing belt 320*m* for the moon. The conventional rotary stamp uses the printing belts obtained as described above.

The conventional rotary stamp described above has the following drawbacks.

Usually the user holds the grip of the stamp and looks at the printing surfaces of the printing areas when operating the turn disks to set the typefaces of desired printing areas on the printing belts to the printing position. It is difficult to confirm this position setting. Further, the printing characters in the printing areas arranged on the printing belts are the reverse of normal character forms. It is difficult to visually recognize relatively complicated printing areas such as accounting subjects. This results in a low efficiency of a printing operation.

The printing belts are wound around the support shafts disposed adjacent the printing position of the conventional stamp. These shafts are formed of fixed plate-like elements which do not move with rotation of the printing belts. A strong force is required for operating the turn disks because of the tension of the printing belts. As a further disadvantage, the printing belts readily wear through friction with the fixed elements, hence low durability.

Moreover, the printing belts of the conventional stamp are exposed as a whole. When the stamp is held by the user or put aside, the ink on the printing surfaces of the printing areas outside the printing position could inadvertently stain the user's hands or other objects.

The printing belts used in the conventional rotary stamp are obtained by preparing the sheet 310 and superposing and joining the opposite ends of the sheet 310 as described above. These printing belts themselves have the following drawbacks.

No printing area can be formed on the joined part of the web 320 formed by joining the opposite ends of the sheet 310. Thus, the web 320 (i.e. printing belts 320*y*, 320$d_1$, 320$d_{10}$ and 320*m* derived from the web 320) includes an unused joint where no printing area can be formed. For increased joining strength, the joint must have a certain length PL (FIG. 3) in the direction of rotation. Consequently, the printing belts 320*y*, 320$d_1$, 320$d_{10}$ and 320*m* have long unused joints occupying part of the outer surfaces defining the printing areas. This means that the printing belts must have an increased overall length in the direction of rotation to accommodate a predetermined number of (the types of) printing areas. The rotary stamp using such printing belts inevitably has an increased size. Where the printing belts have a predetermined length in the direction of rotation, only a limited number of (the types of ) printing areas can be arranged on the outer surfaces of the printing belts.

In the step of joining the opposite ends of the sheet 310, as shown in FIG. 1C, one end 310*a* of the sheet 310 is covered by the other end 310*b* thereof. The joint is made with the foundation 304 under the other end 310*b* being sandwiched between a rubber part 330 on the surface of one end 310*a* and a rubber part 330 on the surface of the other end 310*b*. Thus, the joint has a low joining strength, and each printing belt tends to be broken at the joint. In the course of repeating the operation to rotate the turn disks to rotate the printing belts, the printing belts are often broken at the joints. The rotary stamp using the printing belts obtained as described above has a relatively short life.

The step of joining the opposite ends of the sheet 310 shown in FIG. 1C has been executed manually. The overlapping ends could be joined as misaligned or distorted as shown in FIGS. 4A and 4B. Where the printing belts obtained with the joints misaligned or distorted, the printing areas may be arranged in spiral form. The printing belts 320*y*, 320*$d_1$*, 320*$d_{10}$* and 320*m* obtained from one web 320 may have varied lengths in the direction of rotation. The printing belts 320*y*, 320*$d_1$*, 320*$d_{10}$* and 320*m* may also deviate from a designed length in the direction of rotation. Such printing belts are discarded as useless, which constitutes a waste in manufacture.

SUMMARY OF THE INVENTION

This invention has been made having regard to the state of the art noted above, and its primary object is to provide a rotary stamp which facilitates a visual recognition of desired printing areas set to the printing position of the stamp, and enables this selecting operation to be carried out smoothly for improved printing efficiency.

Another object of this invention is to provide a compact and yet durable rotary stamp with an increased number of printing areas arranged on each printing belt.

The above objects are fulfilled, according to this invention, by a rotary stamp having endless printing belts with plural types of printing areas arranged on outer surfaces thereof, the printing belts being rotatable to set printing surfaces of selected printing areas to a printing position, the rotary stamp comprising:

a printing rotation unit including at least one set of a printing rotation member opposed to a printing support shaft, and an endless printing belt wound around the printing support shaft and the printing rotation member and having plural types of printing areas arranged on an outer surface thereof;

a display rotation unit including at least one display rotation mechanism having, arranged on an outer surface thereof, display characters corresponding to printing characters in the printing areas arranged on the outer surface of the printing belt;

at least one control member for applying torque to the printing rotation member or the display rotation mechanism; and at least one synchronous rotation mechanism for synchronously rotating the printing rotation member and the display rotation mechanism with the torque applied by the control member, such that the printing rotation member is rotated to set the printing surfaces of the printing areas successively to the printing position adjacent the printing support shaft, and the display rotation mechanism is rotated to set, to a display position, display characters corresponding to the printing characters in the printing areas set to the printing position.

The printing characters, as used in this invention, refer to characters, character strings, numerals, numeral strings, signs, sign strings, devices and device strings to be printed on paper and the like, or to combinations of characters, numerals, signs and devices.

The printing areas, as used in this invention, refer to typefaces of the printing characters raised or recessed from the outer surfaces of the printing belts to print the printing characters on paper and the like. The printing characters in the printing areas are the reverse of normal character forms arranged on the outer surfaces of the printing belts.

The printing surfaces of the printing areas are surfaces to which ink is applied and which are pressed on paper and the like.

The display characters refer to characters, character strings, numerals, numeral strings, signs, sign strings, devices device strings, or to combinations of characters, numerals, signs and devices, which correspond to the printing characters arranged on the outer surfaces of the printing belts. The display characters are in normal character form.

With the rotary stamp having the above construction, when the user rotates the control member, the printing rotation member or display rotation mechanism is rotated. Then, the synchronous rotation mechanism synchronously rotates the printing rotation member and the display rotation mechanism to set the printing surfaces of the printing areas successively to the printing position adjacent the printing support shaft, and to set, to the display position, display characters corresponding to the printing characters in the printing areas set to the printing position. That is, the printing surface of a desired printing area is set to the printing position by rotating the control member to set display characters corresponding to the printing characters in the desired printing area, to the display position. Where plural sets of printing rotation members and printing belts are provided, the display rotation mechanism, control member and synchronous rotation mechanism are provided for each set of printing rotation member and printing belt. The above action is performed for each group of printing rotation member, printing belt, display rotation mechanism, control member and synchronous rotation mechanism.

According to this rotary stamp, the printing surface of a desired printing area may be set to the printing position by rotating the control member, without requiring the user to look at the printing surfaces or change grips. The user may select and set a desired printing area while holding the stamp in a posture for impression and looking at the display characters appearing in the display position. The user is unlikely to make a mistake in selecting a printing area since the selection is made by looking at the display characters in normal character form, instead of the printing characters in reversed form in the printing areas arranged on the printing belt. As a result, a printing operation may be carried out with improved efficiency The display rotation mechanism may include a display rotation member rotatable synchronously with the printing rotation member by the synchronous rotation mechanism, a display support shaft opposed to the display rotation member, and an endless display belt wound around the display rotation member and the display support shaft and having, arranged on an outer surface thereof, the display characters corresponding to the printing characters in the printing areas.

With this rotary stamp, when the printing rotation member or display rotation member rotates with rotation of the control member, the synchronous rotation mechanism synchronously rotates the printing rotation member and the display rotation member to set the printing surfaces of the printing areas successively to the printing position adjacent the printing support shaft, and to set, to the display position, the display characters corresponding to the printing characters in the printing areas set to the printing position. This construction allows the housing to have a reduced thickness. The stamp may be formed compact as a whole for improved portability. In addition, large display characters may be used.

Each of the printing rotation member and the display rotation member may define ridges or recesses arranged at fixed intervals on an outer surface thereof, and each of the printing belt and the display belt may define recesses or ridges arranged at fixed intervals on an inner surface thereof for engaging the ridges or recess of the rotation member. Then, no slippage occurs between printing rotation member and printing belt and between display rotation member and display belt, whereby a displacement is avoided in the synchronous rotation of the printing belt and display belt. Consequently, no discrepancy occurs in the positional relationship between the display characters in the display position and the printing area in the printing position, thereby allowing a desired printing area to be selected accurately.

The printing support shaft and the display support shaft may comprise rotatable square shafts. Then, the printing belt and display belt wound around the respective support shafts are smoothly rotatable to enable the control member to be rotated lightly. In the absence of friction between the printing or display belt and the support shaft, the printing belt and display belt have improved durability.

The printing rotation unit may be mounted in a housing defining a printing opening for exposing the printing surface of the printing area set to the printing position, with at least part of the control member protruding outwardly of the housing. Since the printing belt is enclosed in the housing, the user and adjacent objects are protected from ink stains.

The display rotation unit may be mounted in a housing defining a display window having a convex lens fitted therein for magnifying and displaying display characters set to the display position, with at least part of the control member protruding outwardly of the housing. The display characters are visible in enlargement when the user observes the display characters in the display position through the display window, thereby facilitating recognition of the display characters.

At least a portion of the housing opposed to the outer surface of the display rotation mechanism may be formed of a transparent material. This construction allows the user to see the display characters on the outer surface of the display rotation mechanism inside the housing. The user may spot the display characters corresponding to the printing characters in a desired printing area at a glance, thereby to facilitate selection of the printing characters to be set to the printing position.

The printing belt has a variable width depending on the printing characters. Each of the printing rotation member and printing support shaft having a width suited to an individual printing belt of varied width, when manufactured as an integral object, requires labor and high cost. To cope with such a situation, the printing rotation member and/or the printing support shaft may comprise one or more connectable and separable roller elements. Then, a plurality of roller elements having basic widths may be prepared for use in combination to form printing rotation members and printing support shafts suited to the printing belts of varied widths. Thus, once a plurality of roller elements of basic widths are determined beforehand, only those roller elements need to be manufactured. This results in a reduction in labor and cost.

The display rotation member and/or the display support shaft may also comprise one or more connectable and separable roller elements.

The rotary stamp may comprise a penetration type stamp having the printing areas formed of a porous material, and an ink supply mechanism for supplying ink to the printing areas. Then, there is no need to apply ink to the printing surface of a selected printing area by pressing the stamp on an ink pad for each printing operation. This provides improved printing efficiency.

The ink supply mechanism may comprise tubular members forming the printing rotation member and the printing support shaft, with peripheral portions thereof formed of a porous material, for supplying ink contained in the tubular members to the printing areas through the peripheral portions formed of the porous material, or may include at least one ink absorber arranged to contact the printing surfaces of the printing areas.

In the latter case, with the ink absorber contacting the printing surface of a desired printing area, an impression may be may be made on paper or the like before ink is absorbed by the printing area.

The ink absorber may be arranged to contact at least the printing surface of the printing area set to the printing position, and printing surfaces of preceding and succeeding printing areas. Then, in the course of movement to the printing position, the printing surface of a selected printing area always contacts the ink absorber. The printing characters in the selected printing area may be impressed on paper or the like immediately after ink is injected into the ink absorber.

The printing belt wound around the printing support shaft and the printing rotation member may comprise a web formed by stacking a first printing belt forming die, a base material of the printing belt and the printing areas, an intermediate plate having a foundation wrapped thereon, a base material of the printing belt and the printing areas and a second printing belt forming die in the stated order, placing a guide member adjacent two end surfaces of the intermediate plate where the foundation is wrapped, and applying a pressure to move the first forming die and the second forming die toward each other while heating the first forming die and the second forming die.

The printing belt obtained in this way includes no unused joint found in the conventional printing belt. Predetermined types of printing areas may be arranged on the outer surface of the printing belt without unduly extending the length in the rotating direction of the belt. On the other hand, an increased number of printing areas may be arranged on the printing belt having a predetermined length in the rotating direction. Thus, while allowing the rotary stamp to be formed compact, an increased number of printing areas may be arranged on the surface of each printing belt.

The joint itself has increased strength and is reinforced with the foundation. The printing belt is difficult to break or become elongated, to enable the rotary stamp to be used over a long period of time.

Moreover, the printing belt has a correct length in the rotating direction as designed.

In the rotary stamp having the display belt, the printing belt and display belt should preferably be obtained as described above. In preparing the display belt, the first and second dies used are those designed for the display belt, and so is the base material.

As a result, the printing belt and display belt include no unused joints, and are difficult to break or become elongated, to allow the rotary stamp to be formed compact while including a large number of printing areas, and to be used over a long period of time.

In the rotary stamp having the display belt, the display belt must be rotated synchronously with the printing belt to a show, in the display position, the display characters corresponding to the printing characters in the printing area set to the printing position. If, for example, either the printing belt or the display belt has a length in the rotating direction deviating from design, then the display characters displayed in the display position become displaced from the printing characters in the printing area set to the printing position while rotating the printing belt and display belt. Thus, the printing belt and display belt must have a correct length in the rotating directions as designed. The printing belt and display belt obtained as above have a correct length in the rotating directions as designed. This assures a corresponding relationship between the display characters displayed in the display position and the printing characters in the printing area set to the printing position, with no displacement occurring therebetween.

The intermediate plate noted above may define a plurality of grooves for forming the ridges, which are arranged on peripheral surfaces thereof including two end surfaces on which the foundation is wrapped, at fixed intervals along a direction in which the foundation is wrapped. This construction provides the printing belt and display belt with the ridges arranged at fixed intervals on the inner surfaces thereof.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

FIG. 18A is a plan view of a first printing belt forming die;

FIG. 18B is a plan view of a second printing belt forming die;

FIG. 19A is a plan view of an intermediate plate;

FIG. 19B is a side view of the intermediate plate;

DESCRIPTION OF THE PREFERRED EMBODIMENTS

Preferred embodiments of this invention will be described hereinafter with reference to the drawings.

First Embodiment

A rotary stamp in the first embodiment of this invention will be described with reference to FIGS. 5 through 10.

Figure 1A:
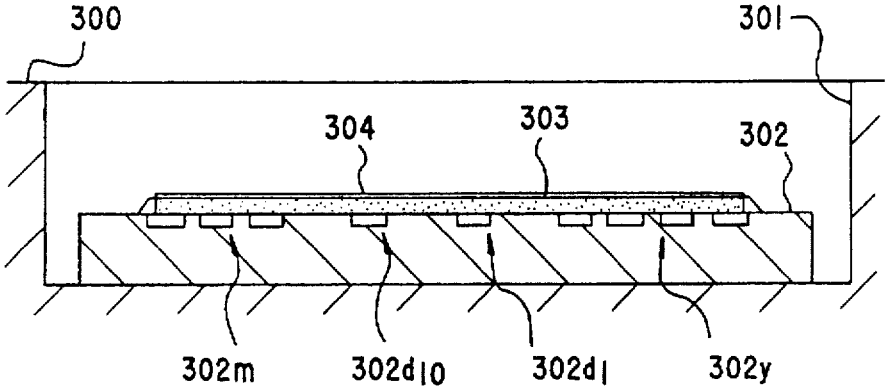
Fig.1A PRIOR ART
FIGS. 1A–1C, 2A and 2B are explanatory views showing a procedure for obtaining printing belts of a conventional rotary stamp.
Figure 1B:
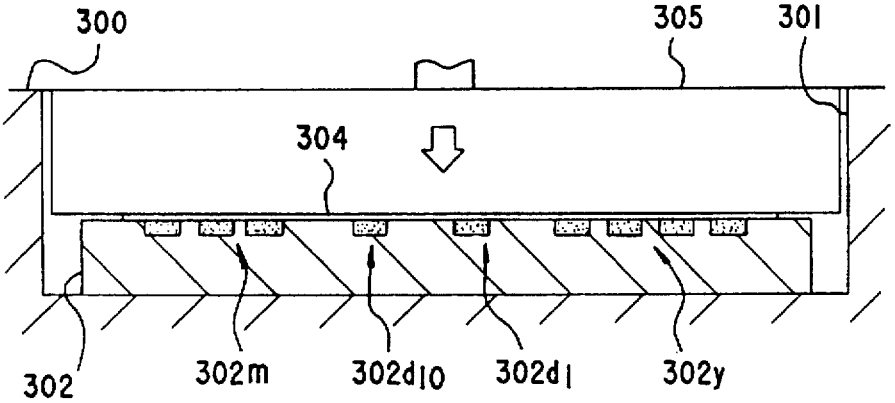
Fig.1B PRIOR ART
Figure 1C:
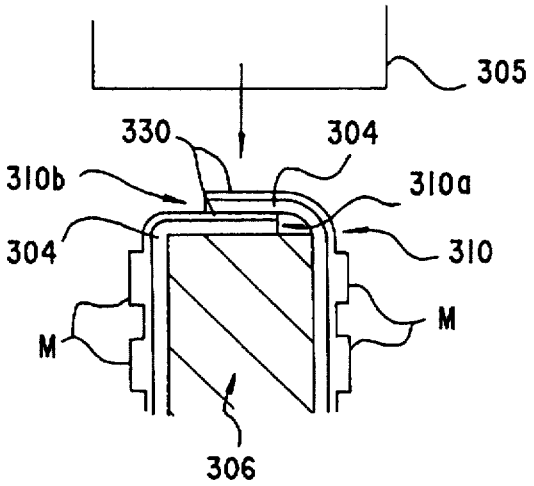
Fig.1C PRIOR ART
Figure 2B:
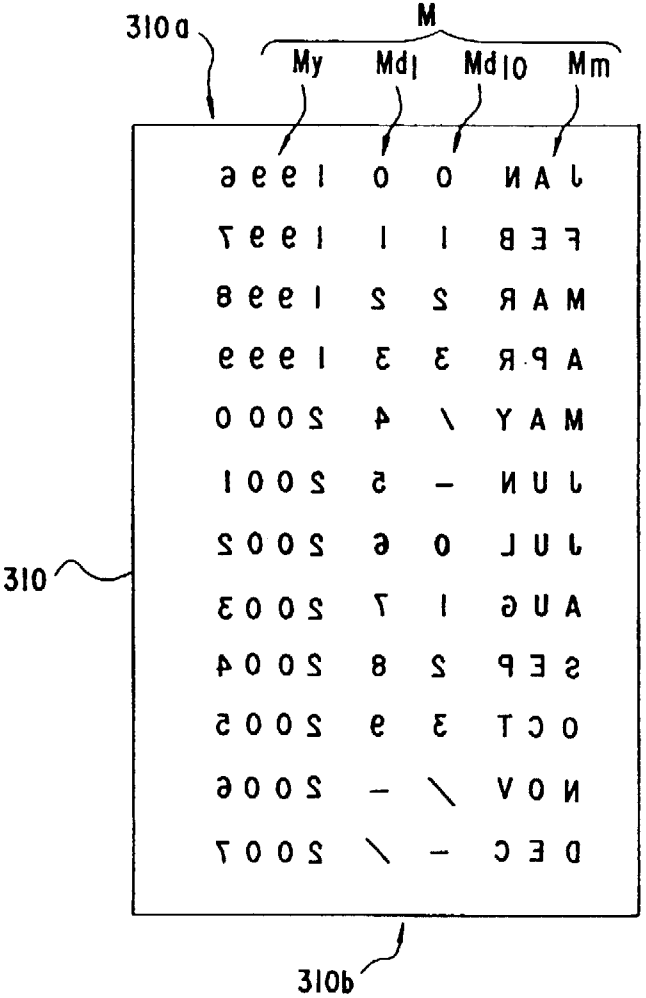
Fig.2B PRIOR ART
Figure 2A:
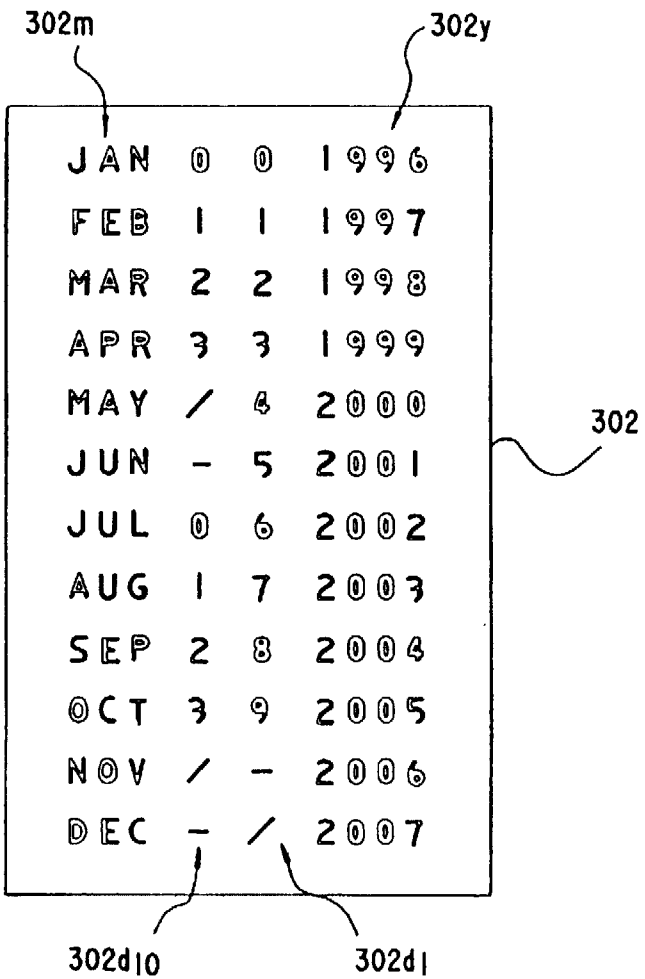
Fig.2A PRIOR ART
Figure 3:
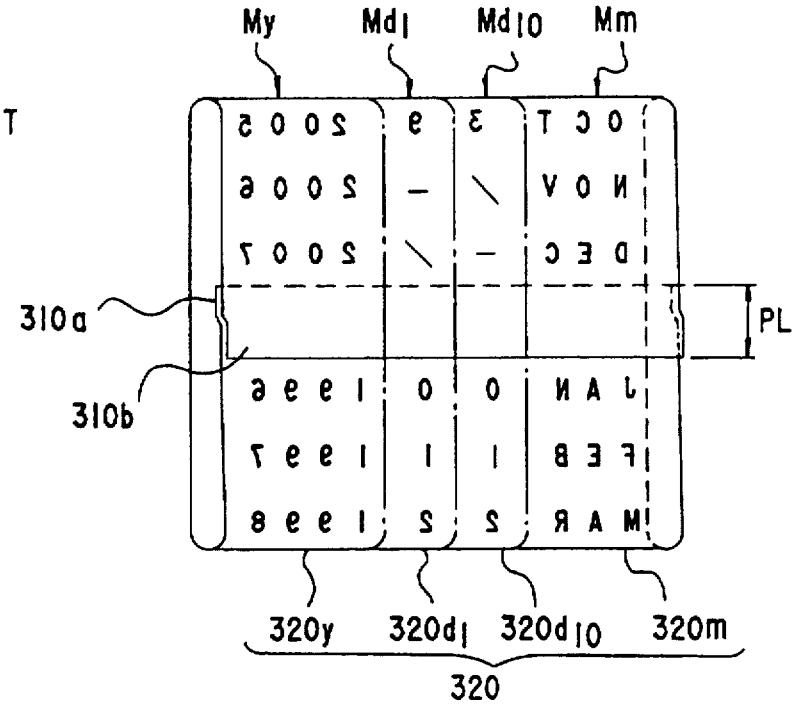
Fig.3 PRIOR ART
FIG. 3 is a perspective view showing conventional printing belts.
Figure 4A:
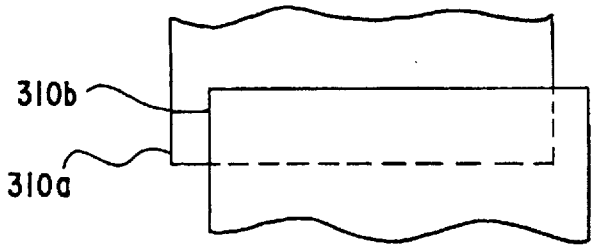
Fig.4A PRIOR ART
FIGS. 4A and 4B are explanatory plan views showing a drawback of the conventional printing belts.
Figure 4B:
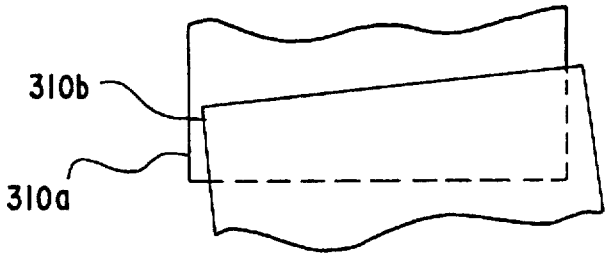
Fig.4B PRIOR ART
Figure 5:
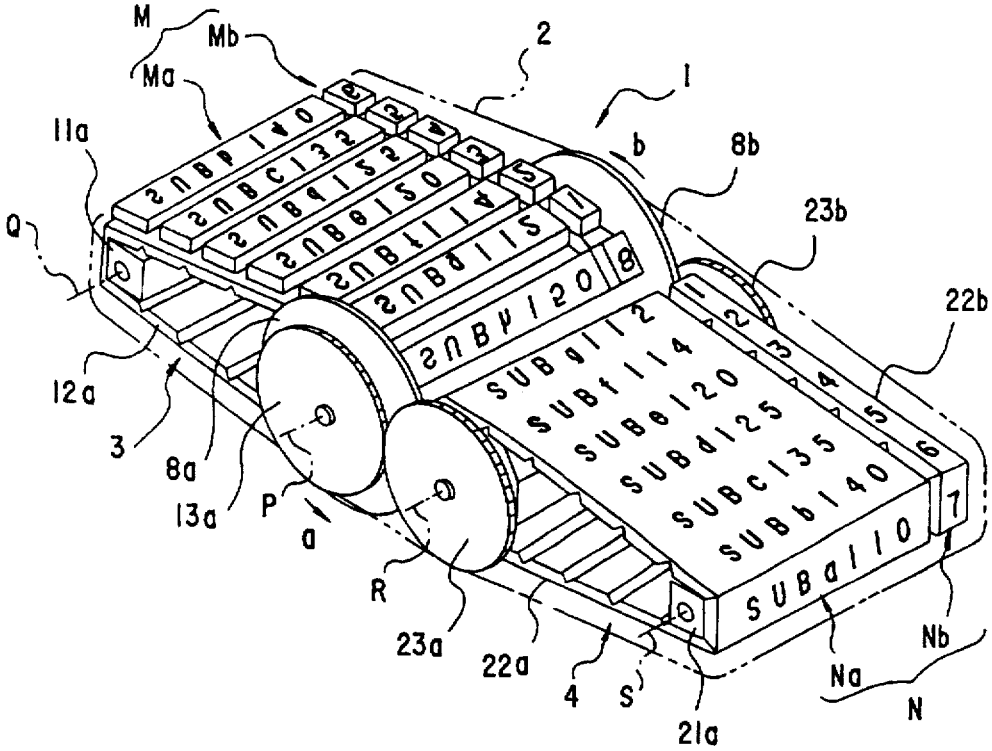
FIG. 5 is an overall perspective view showing internal mechanisms of a rotary stamp in a first embodiment of this invention.
Figure 6:
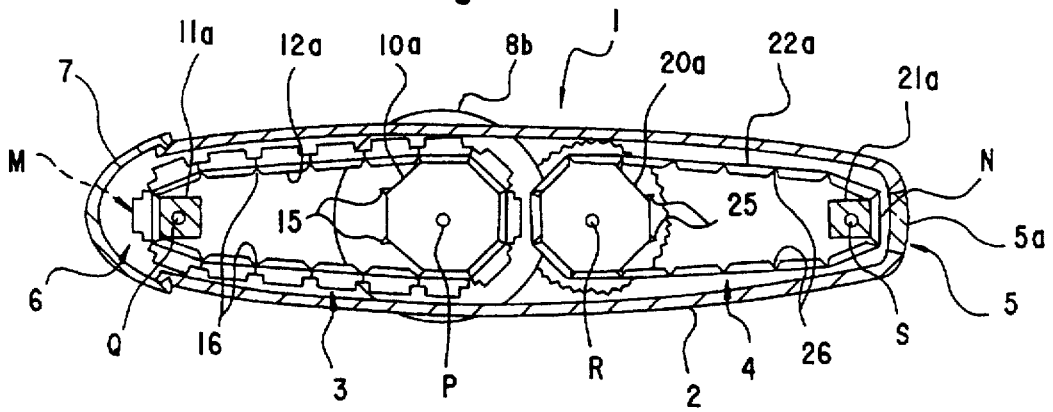
FIG. 6 is a view in vertical section of the rotary stamp in the first embodiment.

As shown in FIGS. 5 and 6, the rotary stamp (hereinafter also called just the stamp) 1 in this embodiment includes a housing 2 whose outer surfaces may be gripped by the user. The housing 2 contains a printing rotation unit 3 and a display rotation unit 4 opposed to each other. The housing 2 has opposite short sides opened. A display window 5 is formed in the opening disposed in a display position of the display rotation unit 4 (rightward in FIG. 6). A convex lens **5*a* is fitted in the opening for magnifying and displaying display characters N described hereinafter. A cap 7 is removably fitted in the opening (printing opening) 6 disposed in a printing position of the printing rotation unit 3 (leftward in FIG. 6). The housing 2 is formed by fitting a pair of upper and lower resin covers at opposite long side edges. Peripheral edges of turn disks (control members) 8*a* and 8*b* protrude from the housing 2** through slots (not shown) formed adjacent the opposite long sides thereof.

Figure 7:
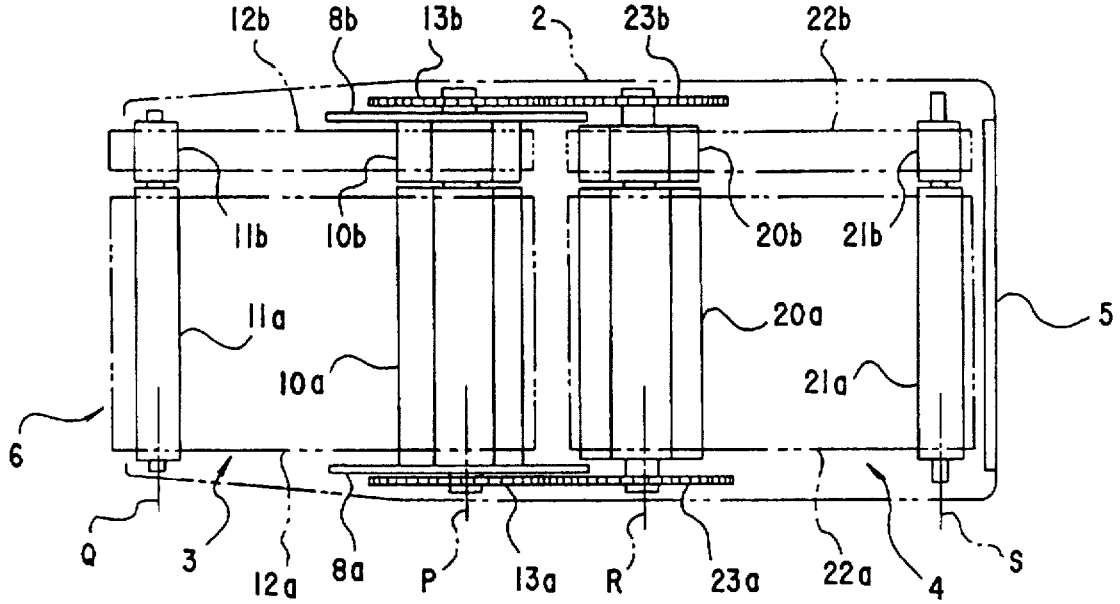
FIG. 7 is a plan view showing a rotating mechanism of the rotary stamp in the first embodiment.
Figure 8:
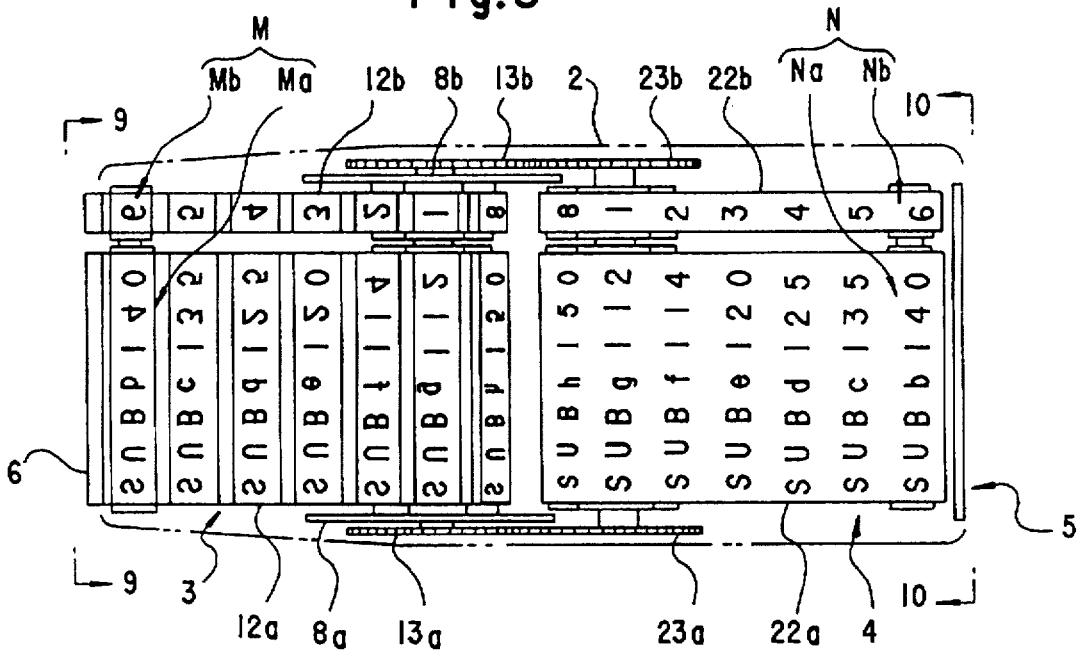
FIG. 8 is a plan view of the rotary stamp in the first embodiment, with an upper portion of a housing removed therefrom.

As shown in FIGS. 6 through 8, the printing rotation unit 3 includes two, long and short, printing rollers (printing rotation members) **10*a* and 10*b* in the form of octagonal bars supported to be rotatable about an axis P adjacent a middle position in the housing 2 (left from the center in FIG. 7), and two, long and short, support shafts 11*a* and 11*b* in the form of square bars supported to be rotatable about an axis Q adjacent the printing opening 6. A broad endless printing belt 12*a* is wound around the long printing roller 10*a* and long support shaft 11*a*. The printing belt 12*a* has printing areas Ma arranged equidistantly on an outer surface thereof for printing accounting subjects and code numbers associated therewith (which will be called collectively hereinafter the accounting subjects or just subjects). A narrow endless printing belt 12b is wound around the short printing roller 10b and short support shaft 11b. The printing belt 12b** has printing areas Mb arranged equidistantly on an outer surface thereof for printing auxiliary code numbers. The printing areas Ma and Mb have raised or recessed typefaces of printing characters of the subjects and auxiliary code numbers. As shown, the characters in the printing areas Ma and Mb are reverse of normal character forms to print normal characters on paper and the like.

In the drawings, the accounting subjects are shown as "SUBa", "SUBb", . . . , "SUBh", and so on. Actually, characters of the accounting subjects are formed in the portions shown as "SUBa", "SUBb", . . . , "SUBh", and so on. For example, "current account" (or its abbreviation) is formed in "SUBa", "bills payable" (or its abbreviation) in SUBb", "accounts payable" (or its abbreviation) in "SUBc", "loans" (or its abbreviation) in "SUBd", "accounts receivable" (or its abbreviation) in "SUBe", "bills receivable" (or its abbreviation) in "SUBf", "time deposits" (or its abbreviation) in "SUBg", and "ordinary deposits" (or its abbreviation) in "SUBh". Also in the portions shown as "SUBa","SUBb", . . . , "SUBh", and so on of the display characters arranged on the outer surfaces of display belts 22a described later, display characters corresponding to the printing characters of the accounting subjects are actually formed. This applies also to the drawings illustrating the second embodiment to be described later.

The above printing belts 12a and 12b and printing areas Ma and Mb may be formed of a rubber material or resin material. A resin material is preferred with a view to minimizing elongation of the printing belts after a long period of use and avoiding ink blur in time of pressing the printing areas M. The display belts 22a and 22b described later should also be formed of a resin material. The printing belts 12a and 12b having the printing areas Ma and Mb arranged equidistantly on the outer surfaces thereof, and the display belts 22a and 22b, should desirably be obtained through a procedure described later. The turn disks 8a and 8b are fixed to the printing rollers 10a and 10b, respectively. A toothed wheel 13a or 13b is connected to one end of each of the long and short printing rollers 10a and 10b for transmitting drive of the turn disk 8a or 8b to rotating mechanisms of the display rotation unit 4 described later.

As shown in FIG. 6, each printing roller 10a (or 10b) includes ridges 15 extending axially on the corners of the outer surface thereof for engaging V-shaped recesses 16 formed at fixed intervals in an inner surface of the endless printing belt 12a (or 12b). The intervals of the recesses 16 of the printing belts 12a and 12b correspond to the intervals of the printing areas M successively arranged on the outer surface thereof, and to the lengths of the sides of the octagonal section of the printing rollers 10a and 10b. The lengths of the sides of the square section of the support shafts 11a and 11b substantially correspond to the intervals of the recesses 16 of the printing belts 12a and 12b.

Figure 9:
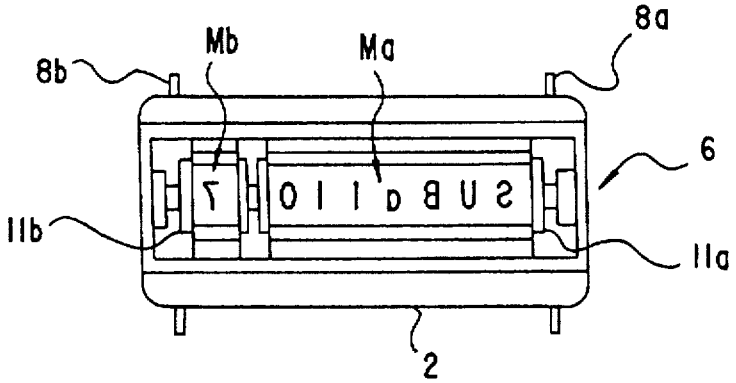
FIG. 9 is a section taken on line 9—9 of FIG. 8.

As shown in FIG. 9, the printing areas M (Ma and Mb) of the accounting subjects and auxiliary code numbers on the outer surfaces of the printing belts 12a and 12b are successively exposed through the printing opening 6 by operation of the turn disks 8a and 8b.

Reverting to FIGS. 6 through 8, the display rotation unit 4 includes two, long and short, display rollers (display rotation members) 20a and 20b in the form of octagonal bars supported to be rotatable about an axis R adjacent the middle position in the housing 2 (right from the center in FIG. 7) and opposed to the printing rollers 10a and 1b, and two, long and short, support shafts 21a and 21b in the form of square bars supported to be rotatable about an axis S inwardly of the display window 5. A broad display belt 22a is wound around the long display roller 20a and long support shaft 21a. The display belt 12a includes a display tape applied thereto, the display tape having prints in normal form of display characters Na corresponding to the printing characters in the accounting subject printing areas Ma arranged on the outer surface of the broad printing belt 12a. A narrow display belt 22b is wound around the short display roller 20b and short support shaft 21b. The display belt 22b also includes a display tape applied thereto, the display tape having prints in normal form of display characters Nb corresponding to the printing characters in the auxiliary code number printing areas Mb arranged on the outer surface of the narrow printing belt 12b. As does each printing roller 10a or 10b, each display roller 20a or 20b includes ridges 25 extending axially on the corners of the outer surface thereof for engaging V-shaped recesses 26 formed at fixed intervals in an inner surface of the endless display belt 22a or 22b (see FIG. 6).

A toothed wheel 23a or 23b is connected to one end of each of the long and short display rollers 20a and 20b and meshed with the toothed wheel 13a or 13b mounted on the printing roller 10a or 10b. These toothed wheels are equal in size and the number of teeth. Consequently, when the turn disk 8 (8a or 8b) is rotated, the display roller 20a or 20b (display belt 22a or 22bis rotatable synchronously with the printing roller 10a or 10b (printing belt 12a or 12b).

Figure 10:
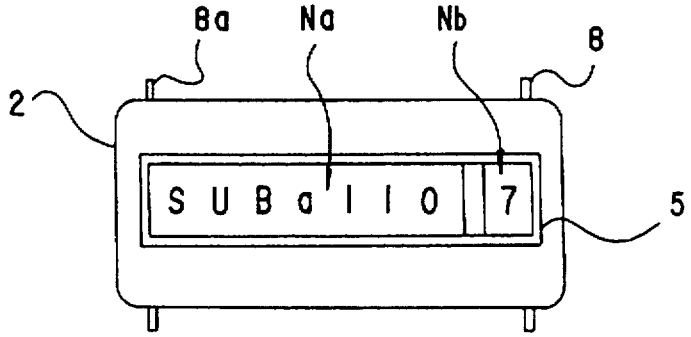
FIG. 10 is a section taken on line 10—10 of FIG. 8.

As shown in FIG. 10, display characters N (Na or Nb) of the accounting subjects or auxiliary code numbers on the display tape are successively displayed in the display window 5 with rotation of the display belt 22a or 22b synchronized with rotation of the printing belt 12a or 12b.

In this embodiment, each display rotating mechanism includes a display rotation member, a display support shaft and a display belt. Two such display rotation mechanisms are provided to correspond in number to the sets of display rotation members and display belts.

According to this display rotation unit 4, the display characters N are arranged successively on the display belts 22 as in the printing rotation unit 3. The housing 2 has a reduced thickness, the stamp 1 is formed compact as a whole, and yet relatively large display characters may be used, compared with the second embodiment described later, in which display characters N are arranged on surfaces of cylindrical bodies. Further, the printing belts 12a and 12b are covered by the housing 2, with only the printing surfaces of desired display areas M are exposed from the printing opening 6. When the stamp 1 is held by the user or put aside, the ink on the printing surfaces of the other printing areas M will never be transferred inadvertently to the user's hands or other objects. At least the part of housing 2 opposed to the outer surfaces of display belts 22a and 22b may be formed of a transparent material. Then, as shown in FIG. 5, the display characters N on the display belts 22a and 22b inside the housing 2 may be observed from outside. This is convenient when setting desired printing areas M to the printing opening 6.

A printing operation of the rotary stamp 1 in this embodiment will be described hereinafter.

Initially, the printing rotation unit 3 and display rotation unit 4 of the rotary stamp 1 are in a positional relationship as shown in FIGS. 5 and 8–10, for example. Assume that the printing areas M and display characters N of "SUBa110 7" ("SUBa" is "current account" or its abbreviation, for example) are situated in the printing opening 6 and display window 5. Assume also that the user now sets desired printing areas M of "SUBg112 5" ("SUBg" is "time deposits" or its abbreviation, for example) to the printing opening 6.

First, the user removes the cap 7 (FIG. 6) to be ready for impression. The user then rotates the turn disk 8*a* protruding from one of the long sides of the housing 2, in the direction of arrow a in FIG. 5, while holding the outer surface of housing 2 and looking at the display window 5. With rotation of the turn disk 8*a*, the long printing roller 10*a* rotates in the direction of arrow a about axis P. This rotates the broad printing belt 12*a* wound around the printing roller 10*a* and printing support shaft 11*a*. The torque of the printing roller 10*a* is transmitted to the display roller 20*a* through toothed wheels 13*a* and 23*a*. This roller 20*a* rotates about axis R in the direction opposite to the direction of arrow a, whereby the display belt 22*a* wound around the roller 20*a* and display support shaft 21*a* rotates synchronously therewith.

At this time, the printing support shaft 11*a* and display support shaft 21*a* rotate about the axes Q and S, with the printing belt 12*a* and display belt 22*a*, respectively. Thus, regardless of the tension of the printing belt 12*a* and display belt 22*a*, the turn disk 8*a* may be rotated with ease. The printing belt 12*a* and display belt 22*a* are free from friction with the support shafts 11*a* and 21*a*, which contributes toward improved durability. As shown in FIG. 6, the ridges 15 and 25 formed on the corners of the outer surfaces of the printing roller 10*a* and display roller 20*a* engage the recesses 16 and 26 formed in the inner surfaces of the endless printing belt 12*a* and display belt 22*a* in rotation. Thus, no displacement occurs between the printing belt 12*a* and display belt 22*a* in rotation, to ensure a synchronous rotation of the printing belt 12*a* and display belt 22*a*.

With a continued rotation of the turn disk 8*a*, as shown in FIGS. 5 and 8, display characters Na of "SUBb140" ("SUBb" is "bills payable" or its abbreviation, for example) arranged next and the following "SUBc135" ("SUBc" is "accounts payable" or its abbreviation) successively move past the display window 5. When the display characters Na of "SUBg112" are displayed, the user stops rotating the turn disk 8*a*. In this state, the printing area M of "SUBg112" is set to the printing opening 6 to complete the operation to select the printing area Ma of the desired subject.

The display window 5 currently shows "7" as display character Nb of the auxiliary code number. Assume that this is to be replaced with the display character Nb of "5". As in the selecting operation for the printing area Ma of the subjects, the user rotates the turn disk 8*b* protruding from the other long side of the housing 2, in the direction of arrow b in FIG. 5. With rotation of the turn disk 8*b*, the short printing roller 10*b* rotates in the direction of arrow a about axis P. This rotates the narrow printing belt 12*b* wound around the roller 10*b* and printing support shaft 11*b*. Through the toothed wheels 13*b* and 23*b*, the display roller 20*b* is rotated about axis R in the opposite direction, whereby the display belt 22*b* wound around the roller 20*b* and display support shaft 21*b* rotates synchronously therewith.

With a continued rotation of the turn disk 8*b*, the display characters Nb of "6" arranged next moves past the display window 5. When the display character Nb of "5" is displayed, the user stops rotating the turn disk 8*b*. In this state, the printing surface of the printing area Mb of auxiliary code number "5" is set to the printing opening 6 to complete the selecting operation. As a result of this operation, the printing areas M of "SUBg112 5" which the user desires are set to the printing opening 6.

In the above selecting operation, the turn disks 8*a* and 8*b* are rotated in the direction of arrows a and b in FIG. 5. Of course, the turn disks 8*a* and 8*b* may be rotated in the opposite direction. The two turn disks 8*a* and 8*b* may be rotated at the same time to set the printing areas Ma and Mb of the desired subject and auxiliary code number simultaneously.

Once the desired printing areas M have been set, the user puts ink to the printing surfaces of the printing areas M of "SUBg112 5" exposed through the printing opening 6, and makes an impression on appropriate paper or the like.

Figure 11:
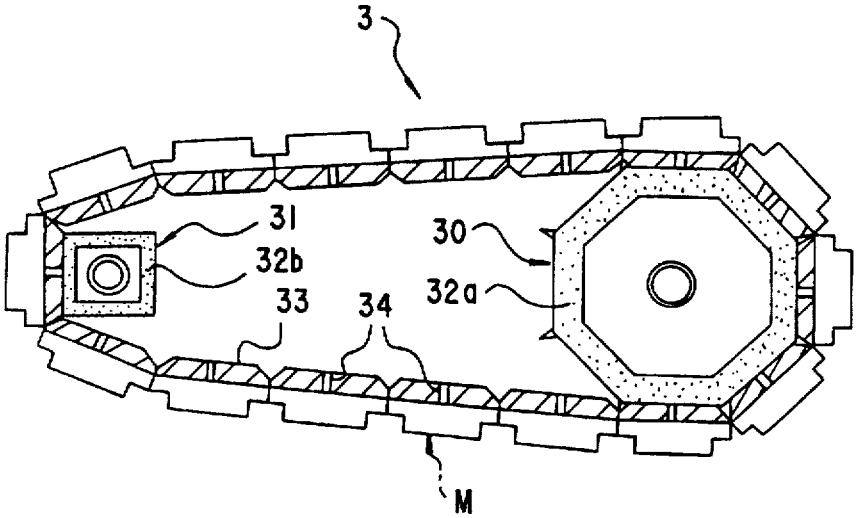
FIG. 11 is a view in vertical section of a printing rotation unit of a penetration type rotary stamp.
Figure 12A:
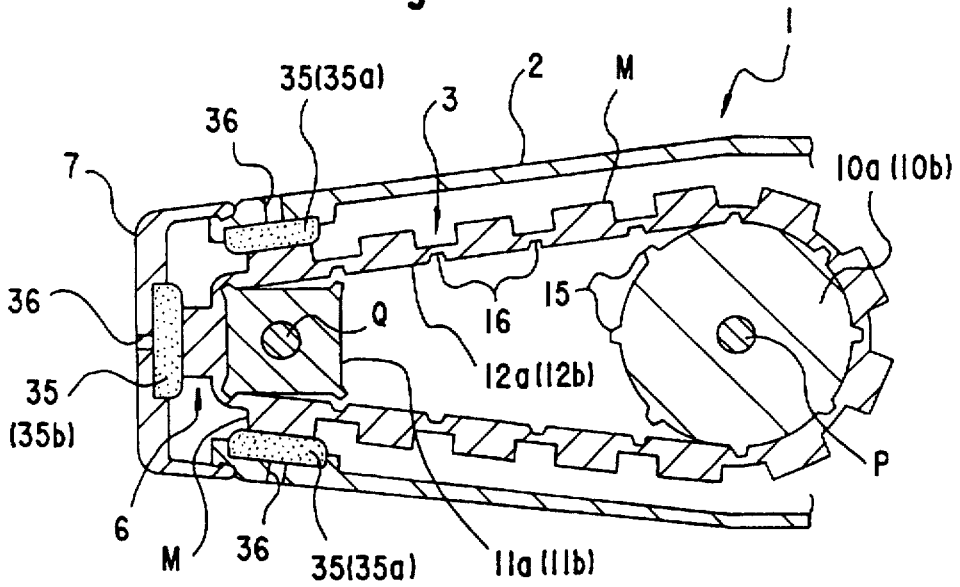
FIGS. 12A and 12B are views in vertical section of a printing rotation unit in a different penetration type rotary stamp.
Figure 12B:
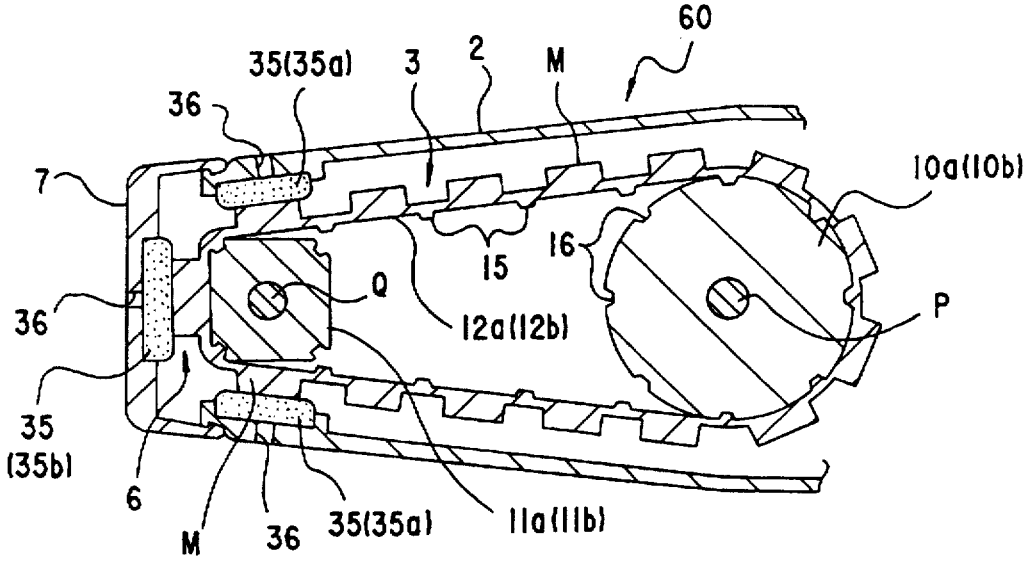

This rotary stamp may be constructed as penetration type stamps as shown in FIG. 11 and FIGS. 12A and 12B.

The construction shown in FIG. 11 includes tubular printing rollers 30 and printing support shafts 31 having porous outer peripheries 32*a* and 32*b*. The rollers 30 and support shafts 31 have tubular interiors thereof filled with ink. The printing areas M also are formed of a porous material. Printing belts 33 define inking bores 34 for constantly supplying the ink to the printing areas M. In the construction of FIG. 11, the printing belts 33 may also be formed of a porous material to dispense with the inking bores 34.

In the construction shown in FIGS. 12A and 12B, the printing belts 12*a* and 12*b* and printing areas M are formed of a porous material, and ink absorbers 35 (35*a* and 35*b*) are mounted on the inner surfaces of the housing 2 and cap 7 to contact the printing surfaces of printing areas M. The housing 2 and cap 7 define ink injection bores 36. A syringe-like ink injector (not shown) is used to inject ink through the injection bores 36 to be absorbed by the ink absorbers 35 (35*a* and 35*b*). Instead of forming the ink injection bore 36 in the cap 7, ink may be injected into the ink absorber 35*b* attached to the inner surface of the cap 7 when the cap 7 is detached from the housing 2. When the ink is absorbed by the ink absorbers 35, the ink is absorbed through the printing surface of the porous printing areas M contacting the ink absorbers 35. The ink is applied to all of the printing areas M by way of the porous printing belts 12*a* and 12*b*.

In the constructions shown in FIG. 11 and FIGS. 12A and 12B, the stamps do not function as the penetration type until ink is absorbed by the printing areas M after filling or injection. In the construction shown in FIGS. 12A and 12B, since the ink absorbers 35 contact the printing surfaces of printing areas M, an impression may be made on paper or the like after the printing surfaces of desired printing areas M are placed in contact with the ink absorbers 35 even if ink is not absorbed by all of the printing areas M. In particular, as shown in FIGS. 12A and 12B, the ink absorbers 35*a* are arranged on the inner surfaces of the housing 2 so as to contact the printing surfaces of printing areas M immediately preceding and succeeding the printing areas M located in the printing opening 6. When, in the state shown in FIGS. 12A and 12B, ink is absorbed by the ink absorbers 35*a* and 35*b*, the printing surfaces of selected printing areas M, in the course of movement to the printing opening 6, contact the ink absorbers 35 without fail. Thus, the printing characters of the selected printing areas M may be impressed on paper or the like immediately after ink is injected into the ink absorbers 35*a* and 35*b*.

FIG. 12B corresponds to the third embodiment described hereinafter. In the penetration type stamp 60, the printing rollers 10*a* and 10*b* define recesses 16 instead of ridges 15, and the printing belts 12*a* and 12*b* define ridges 15 instead of recesses 16 on the inner surfaces thereof. In the construction shown in FIG. 11 also, the printing rollers 10*a* and 10*b* may define recesses 16 instead of ridges 15, and the printing belts 12*a* and 12*b* may define ridges 15 instead of recesses 16 on the inner surfaces thereof.

According to the rotary stamp 1 in this embodiment, the printing areas Ma and Mb arranged peripherally of the printing belts 12*a* and 12*b* may be set to the printing opening 6 while rotating the turn disks 8*a* and 8*b*, without requiring the user to look at the printing surfaces or change grips as with the conventional stamp. Thus, the set position may be confirmed with ease. The user may select and set desired printing areas M while holding the stamp 1 in a posture for impression and looking at the display window 5. The display window 5 shows, in enlargement, the display characters Na and Nb in normal character form, instead of the printing characters in reversed form. Even the relatively complicated characters such as of accounting subjects are easy to recognize, so that the user is unlikely to make a mistake in selection. As a result, a printing operation may be carried out with improved efficiency.

Second Embodiment

A rotary stamp in the second embodiment of this invention will be described next with reference to FIGS. 13 and 14.

This rotary stamp 50 basically comprises a modification of the display rotating mechanisms of the rotary stamp 1 in the first embodiment.

Figure 13:
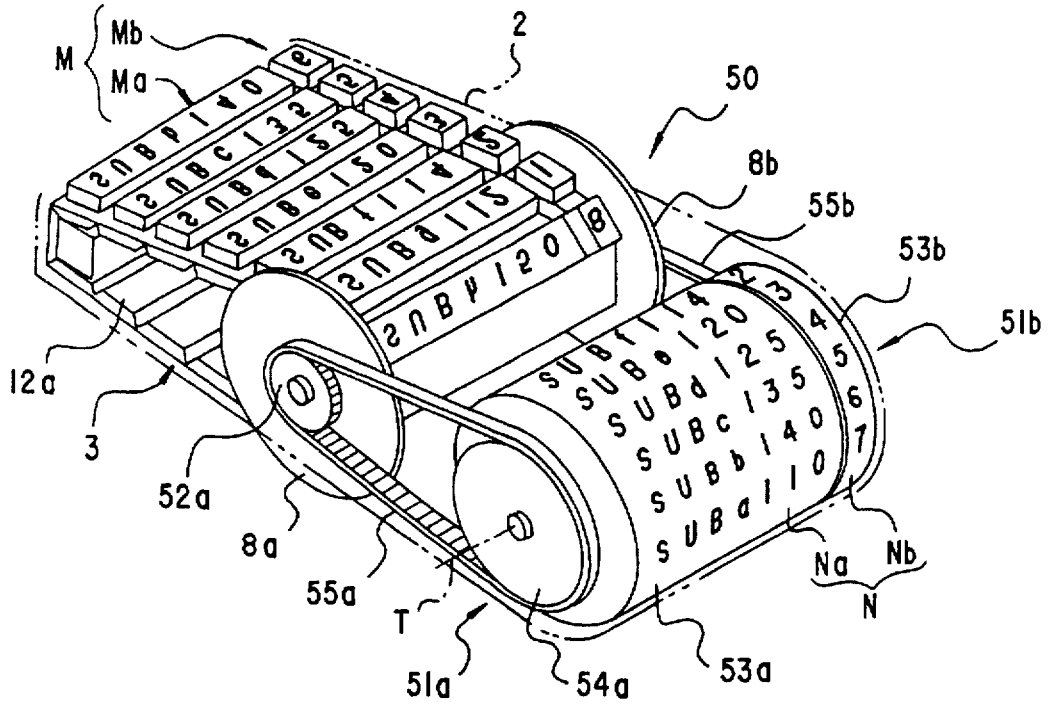
FIG. 13 is an overall perspective view showing internal mechanisms of a rotary stamp in a second embodiment of this invention.
Figure 14:
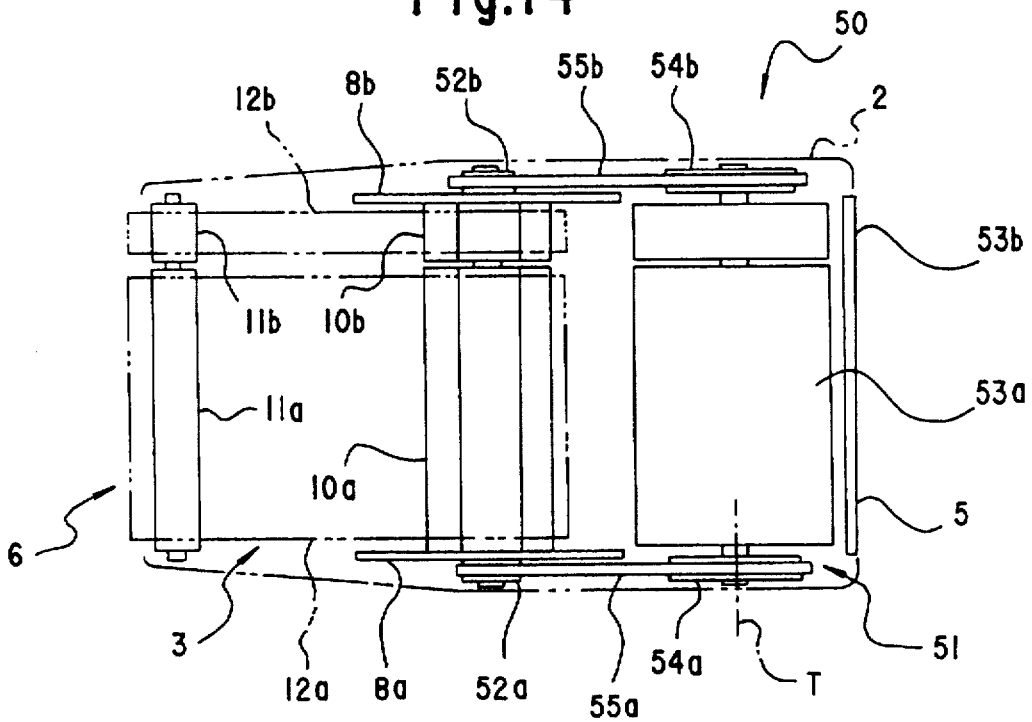
FIG. 14 is a plan view showing a rotating mechanism of the rotary stamp in the second embodiment.

As shown in FIGS. 13 and 14, timing pulleys 52*a* and 52*b* are connected to the outer ends of the printing rollers 10*a* and 10*b* for transmitting the torque of the turn disks 8*a* and 8*b* to display rotating mechanisms 51*a* and 51*b*. Two, long and short, cylindrical display rollers 53*a* and 53*b* are supported inwardly of the display window 5 to be rotatable about an axis T. The long display roller 53*a* includes a display tape applied thereto, the display tape having prints in normal form of display characters Na corresponding to the printing characters in the accounting subject printing areas Ma arranged on the outer surface of the broad printing belt 12*a*. The short display roller 53*b* also includes a display tape applied thereto, the display tape having prints in normal form of display characters Nb corresponding to the printing characters in the auxiliary code number printing areas Mb arranged on the outer surface of the narrow printing belt 12*b*. Timing pulleys 54*a* and 54*b* are connected to outer ends of the display rollers 53*a* and 53*b*. Timing belts 55*a* and 55*b* are wound around these timing pulleys 54*a* and 54*b* and the timing pulleys 52*a* and 52*b* associated with the printing rollers 10*a* and 10*b*, respectively. These timing belts 55*a* and 55*b* are formed of a resin material little extendible through use. The timing pulleys 52*a* and 52*b* associated with the printing rollers 10*a* and 10*b*, and the timing pulleys 54*a* and 54*b* associated with the display rollers 53*a* and 53*b*, have diameters whose ratio is determined such that, when the printing belts 12*a* and 12*b* make one rotation with rotation of the turn disks 8*a* and 8*b*, the display rollers 53*a* and 53*b* also make one rotation. Thus, the printing rollers 10*a* and 10*b* and display rotating mechanisms 51*a* and 51*b* rotate in synchronism.

The other aspects are substantially the same as in the first embodiment. Like reference numerals are used to identify like parts in the first embodiment, and will not be described again.

In an operation of this rotary stamp 50, when the turn disk 8*a* is rotated, the printing roller 10*a* rotates and its torque is transmitted to the display roller 53*a* through the timing belt 55*a* to rotate the display roller 53*a*. Similarly, when the turn disk 8*b* is rotated, the printing roller 10*b* and display roller 53*b* rotate in synchronism. The user looks at the display characters N displayed in enlargement in the display window 5, and stops rotating the turn disks 8*a* and 8*b* when the display characters N corresponding to the printing characters of desired printing areas M are displayed. In this way, the desired printing areas M are set to the printing opening 6. According to this embodiment, the housing 2 of the display rotation mechanisms 51*a* and 51*b* has a slightly increased thickness, but the stamp has advantages similar to the first embodiment.

Third Embodiment

Figure 15:
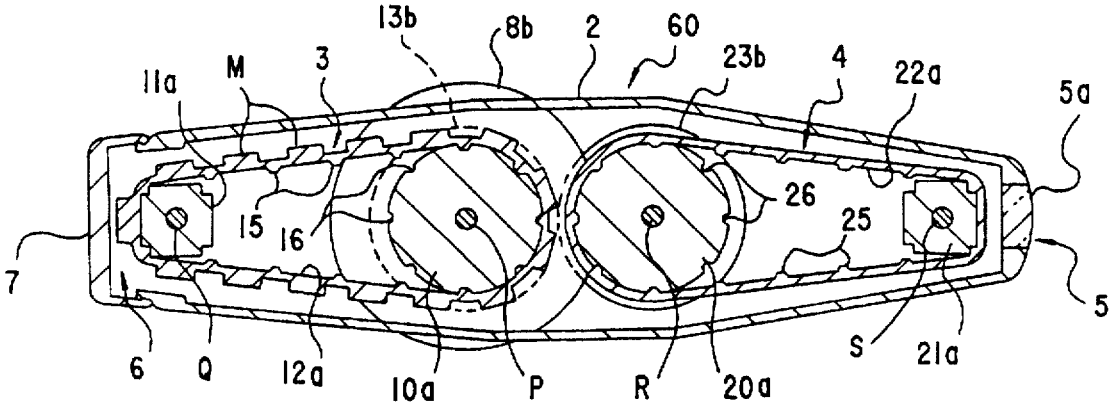
FIG. 15 is a view in vertical section of a rotary stamp in a third embodiment of this invention.

A rotary stamp in the third embodiment of this invention will be described next with reference to FIG. 15.

In this rotary stamp 60, the ridges 15 formed on the printing rollers 10*a* and 10*b* in the first embodiment are replaced with recesses 16, and the recesses 16 in the inner surfaces of printing belts 12*a* and 12*b* are replaced with ridges 15. Similarly, the ridges 25 formed on the display rollers 20*a* and 20*b* are replaced with recesses 26, and the recesses 26 formed in the inner surfaces of display belts 22*a* and 22*b* are replaced with ridges 25. The other aspects are substantially the same as in the first embodiment. Like reference numerals are used to identify like parts in the first embodiment, and will not be described again.

With the ridges 15 and 25 and recesses 16 and 26 interchanged as described above, no displacement occurs between the printing belts 12*a* and 12*b* and display belts 22*a* and 22*b* in rotation as in the first embodiment to ensure synchronous rotations of the printing belts 12*a* and 12*b* and display belts 22*a* and 22*b*.

With the recesses 16 and 26 formed in the printing belts 12*a* and 12*b* and display belts 22*a* and 22*b*, the recessed portions are thin and the printing belts 12*a* and 12*b* and display belt 22*a* and 22*b* may be broken in those portions with ease. This inconvenience is avoided where, as in the third embodiment, the ridges 15 and 25 are formed on the printing belts 12*a* and 12*b* and display belts 22*a* and 22*b*.

The rotary stamp according to this invention may be modified as follows:

(1) In the first to third embodiments described above, the two, long and short, printing belts 12*a* and 12*b* have the printing areas Ma and Mb of the accounting subjects and auxiliary code numbers. The type of printing areas M is not limited thereto. For example, the printing areas M may be varied to represent numerals for dates, names of persons, marks or signs. The stamp 1 (50, 60) may have a correspondingly modified display rotation unit 4 (51). The number and width of printing belts 12 may be varied according to the type of printing areas M.

(2) The printing belts 12*a* and 12*b* are rotated by the control members in the form of thin turn disks 8*a* and 8*b* with edges thereof protruding from the opposite sides of the housing 2. Instead, the stamp 1 (50, 60) may include dial or handle type control members connected to the printing rollers 10*a* and 10*b* and disposed at the opposite sides of the housing 2. The control members may be connected to the display rotation mechanisms (display rotation members) to rotate the printing rotation members synchronously with the display rotation mechanisms (display rotation members).

(3) The display window 5 (display position) with a convex lens may be disposed in any position for facilitating visual recognition according to the shape of housing 2 and the posture for impression. Wherever the display window 5 is, an adjustment may be made to move the display characters N corresponding to the printing characters of the printing areas M set to the printing opening 6, to a position opposed to the window 5 (set to the display position).

(4) In the first to third embodiments, the toothed wheels 13 and 23 are disposed at the ends of the printing rollers 10 and display rollers 20 for transmitting drive produced by rotation of the turn plates 8 from the printing rollers 10 to the display rollers 20. Alternatively, the drive may be transmitted through timing belts or the like.

(5) The printing rollers 10*a* and 10*b* in the first to third embodiments, and the display rollers 20*a* and 20*b* in the first and third embodiments, may be in the form of polygonal bars (with a polygonal section). Where the printing belts and display belts are flexible webs obtained from a procedure described hereinafter, the rollers may be formed cylindrical (with a circular section) as in the third embodiment.

Figure 16A:
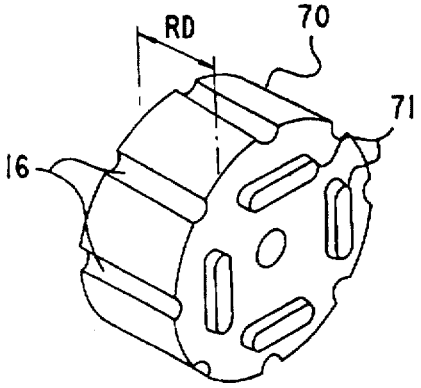
FIGS. 16A and 16B are perspective views showing a modified printing roller.
Figure 16B:
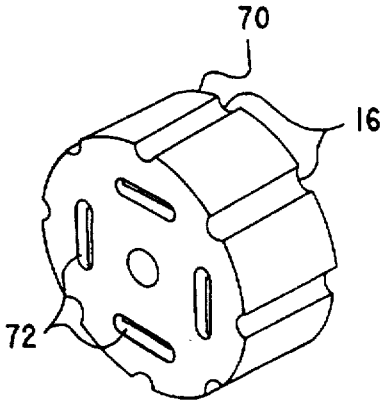
Figure 16C:
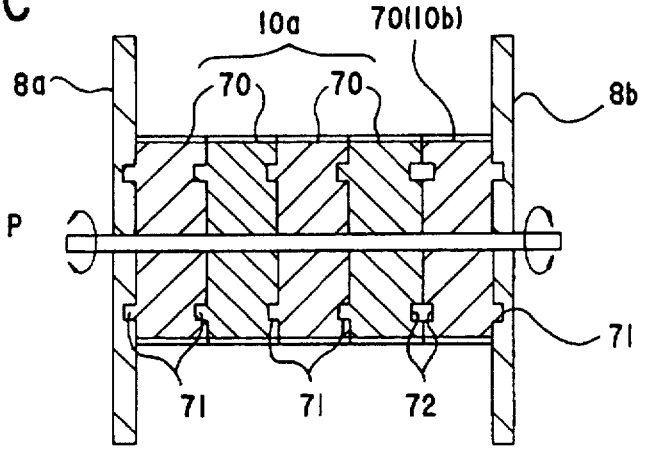
FIG. 16C is a view in vertical section of the modified printing roller.

(6) The printing rollers 10*a* and 10*b* in the first to third embodiments may be formed of connectable and separable roller elements 70 as shown in FIGS. 16A–16C. Each of these roller elements 70 includes coupling projections 71 formed on one end surface thereof, and coupling recesses 72 formed in the other end surface. The coupling projections 71 of one roller element 70 are fitted in the coupling recesses 72 of another roller element 70 to be rotatable together about axis P. It is of course possible to remove the coupling projections 71 from the coupling recesses 72. With this construction, for example, roller elements 70 having widths RD of 4 mm, 6 mm and 8 mm may be prepared, and the roller elements 70 of different widths may be combined to form printing rollers 10*a* and 10*b* for winding printing belts 12*a* and 12*b* of desired width. The printing belts 12*a* and 12*b* have a variable width depending on the accounting subjects and the like. Each of the printing rollers 10*a* and 10*b* having a width suited to an individual printing belt 12*a* or 12*b* of varied width, when manufactured as an integral object, requires labor and high cost. According to the construction shown in FIGS. 16A–16C, a plurality of roller elements 70 having basic widths may be prepared to cope with printing belts 12*a* and 12*b* of varied widths. Thus, once a plurality of roller elements 70 of basic widths are determined beforehand, only those roller elements 70 need to be manufactured. This results in a reduction in labor and cost. The above construction is applicable also to the printing support shafts 11*a* and 11*b*, and to the display rollers 20*a* and 20*b* and display support shafts 21*a* and 21*b* in the first and third embodiments.

Next, a procedure for obtaining printing belts and display belts suited to the rotary stamp will be described.

First, a procedure for obtaining printing belts having printing areas arranged on outer surfaces thereof will be described with reference to FIGS. 17A, 17B, 18A, 18B, 19A, 19B, 20, 21, 22, 23A–23C, 24A–24D and 25A–25C. These printing belts include, for example, the year, the month, the upper digit (second digit) of the day, and the lower digit (first digit) of the day.

The manufacture of the printing belts uses a base block, a manufacturing frame, a presser, a first and a second printing belt forming dies, a base material of the printing belts and printing areas (web), an intermediate plate, a foundation and a guide frame.

Figure 17A:
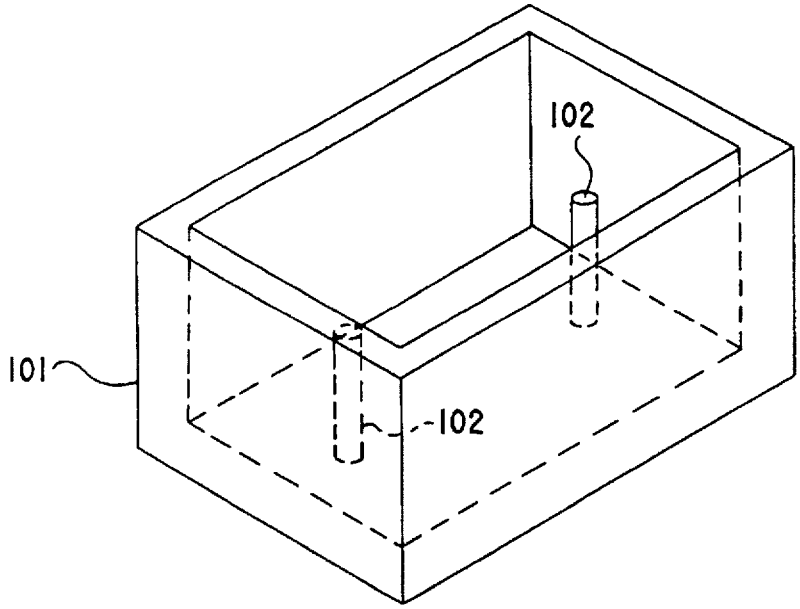
FIG. 17A is a perspective view of an apparatus for manufacturing belts for use in the rotary stamp.
Figure 17B:
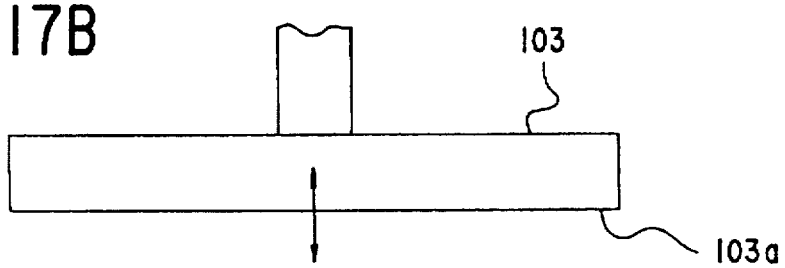
FIG. 17B is a view in vertical section of the belt manufacturing apparatus.
Figure 17B:
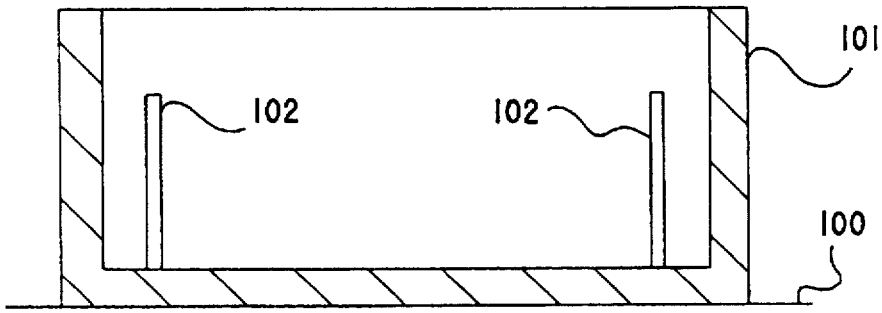

As shown in FIGS. 17A and 17B, a base block 100 formed of a material of high heat conduction such as steel has a heater, not shown, mounted therein. A box-like manufacturing frame 101 with an open top is placed on the base block 100. The manufacturing frame 101 also is formed of a material of high heat conduction such as steel, and includes two adjusting rods 102 erected inside. A presser 103 stands by above the upper opening of the manufacturing frame 101. The presser 103 is formed of a material of high heat conduction such as steel and has a heater, not shown, mounted therein. This presser 103 is vertically movable. When lowered, the presser 103 applies a predetermined downward pressure to an object contacting a lower surface 103*a* thereof.

As shown in FIGS. 18A and 18B, a first forming die 110*a* and a second forming die 110*b* define forming recesses (recesses corresponding to the shapes of printing characters) 110*c* in surfaces thereof for forming the printing areas arranged on the outer surfaces of the printing belts. These recesses include forming recesses 110*m* for the month, forming recesses $\mathbf{110}d_{10}$ for the upper digit of the day, forming recesses $\mathbf{110}d_1$ for the lower digit of the day, and forming recesses 110*y* for the year. The surface of the first forming die 110*a* has forming recesses 110*c* for forming half of the printing areas arranged on the outer surfaces of the printing belts. The surface of the second forming die 110*b* has forming recesses 110*c* for forming the remaining half of the printing areas arranged on the outer surfaces of the printing belts. The first forming die 110*a* and second forming die 110*b* define positioning bores 110*d* penetrable by the rods 102 erected inside the manufacturing frame 101, to position the first and second forming dies 110*a* and 110*b* therein.

A thin rubber or resin sheet is used as the base material for the printing belts and printing areas. This sheet is slightly shorter than length HL (FIG. 18A) of a frame, shown in a dot-and-dash line, surrounding the forming recesses 110*c* arranged on the surface of each forming die 110*a* or 110*b*, and slightly narrower than width HW (FIG. 18A) of the frame. When making a penetration type stamp, a porous material may be used as a base material after manufacturing printing belts.

As shown in FIGS. 19A and 19B, an intermediate plate 111 has grooves 111*a* formed at predetermined intervals PP in upper and lower surfaces and opposite end surfaces thereof. These grooves 111*a* are used to form the ridges (15) arranged at the predetermined intervals on the inner surfaces of the printing belts. The intervals PP of the grooves 111*a* correspond to the intervals of the recesses (16) of printing rollers (10*a*, 10*b*). The intervals between the grooves 111*a* at the opposite ends of the upper and lower surfaces and the intervals between the grooves 111*a* in the end surfaces are the same as the intervals between the grooves 111*a* (PP1+PP2=PP). Thus, intervals PP1 in the drawings may be increased for forming printing areas, by providing the grooves 111*a* for forming the ridges (15) and reducing the intermediate plate 111 to a relatively small thickness ND. The printing areas may be arranged in all spaces between the ridges (15) when manufacturing the printing belts. The intermediate plate 111 has a length NL substantially corresponding to the length HL (FIG. 18A) of the frame surrounding the forming recesses 110*c* arranged on the surface of each forming die 110*a* or 110*b*, and a width NW slightly smaller than the width HWW (FIG. 18A) of the frame. The intermediate plate 111 also defines positioning bores 111*b* penetrable by the rods 102 erected inside the manufacturing frame 101, to position the intermediate plate 111 therein (relative to the first and second forming dies 110*a* and 110*c*).

Figure 20:
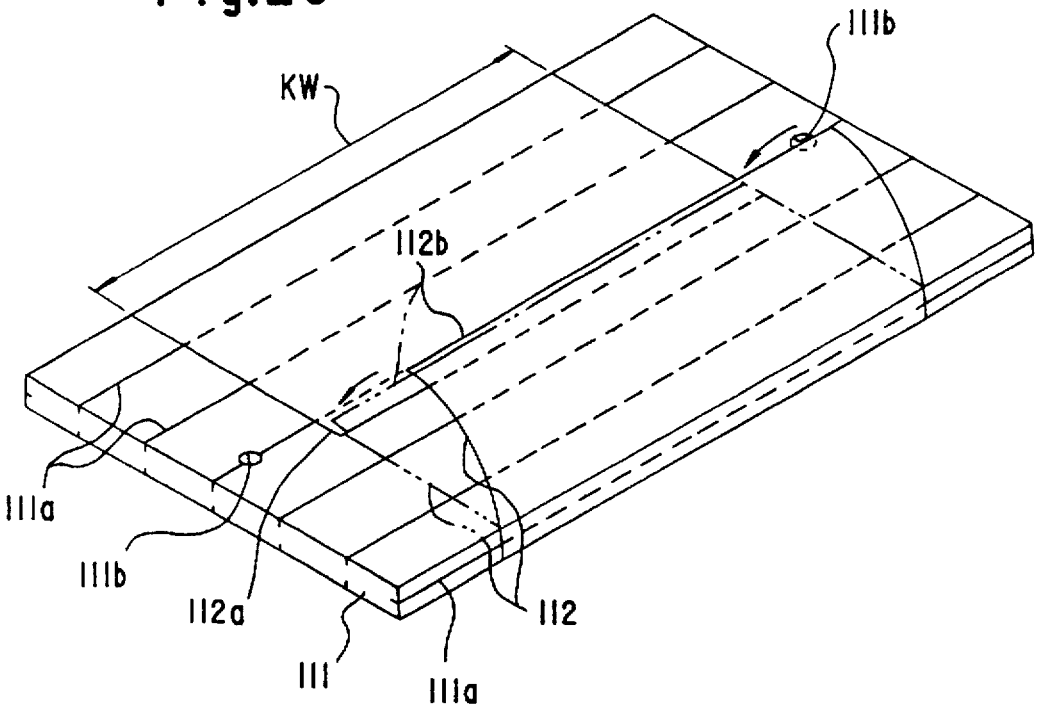
FIG. 20 is a perspective view of a foundation.

The foundation 112 comprises a coarse hemp cloth or synthetic fiber. As shown in FIG. 20, the foundation 112 is wrapped around the intermediate plate 111 in the direction of arrangement of the grooves 111*a* of the intermediate plate 111. The foundation 112 has a width KW substantially corresponding to or slightly larger than the width HW (FIG. 18A) of the frame surrounding the forming recesses 110*c* arranged on the surface of each forming die 110*a* or 110*b*. The foundation 112 has such a length that opposite ends 112*a* and 112*b* thereof overlap each other when the foundation 112 makes one wrap around the intermediate plate 111.

Figure 21:
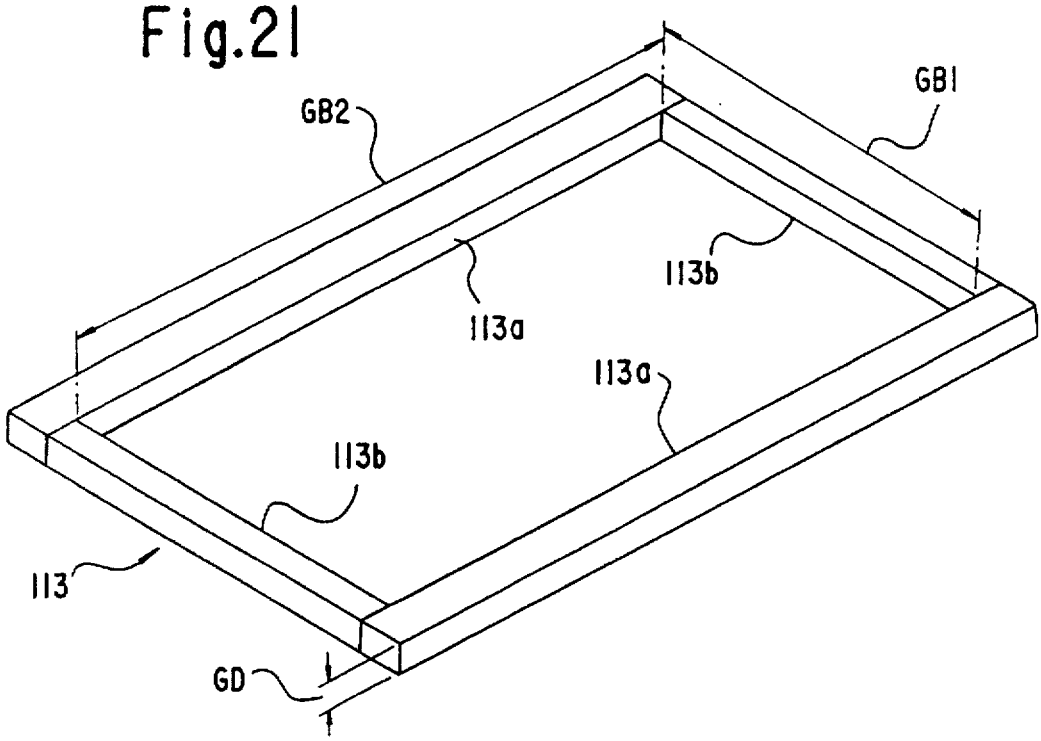
FIG. 21 is a perspective view of a guide frame.

As shown in FIG. 21, a guide frame 113 has an architrave shape, with two opposed guide members 113*a*, and two connecting members 113*b* interconnecting the guide members 113*a* at the opposite ends thereof. The guide frame 113 (guide members 113*a* and connecting members 113*b*) has a thickness GD substantially corresponding to thickness ND of the intermediate plate 111. The guide members 113*a* have inner surfaces opposed to each other with a spacing GB1 therebetween for just receiving the intermediate plate 111 with the foundation 112 wrapped thereon, or slightly larger than that. The connecting members 113*b* have inner surfaces opposed to each other with a spacing GB2 therebetween, which substantially corresponds to the width NW of the intermediate plate 111.

Figure 22:
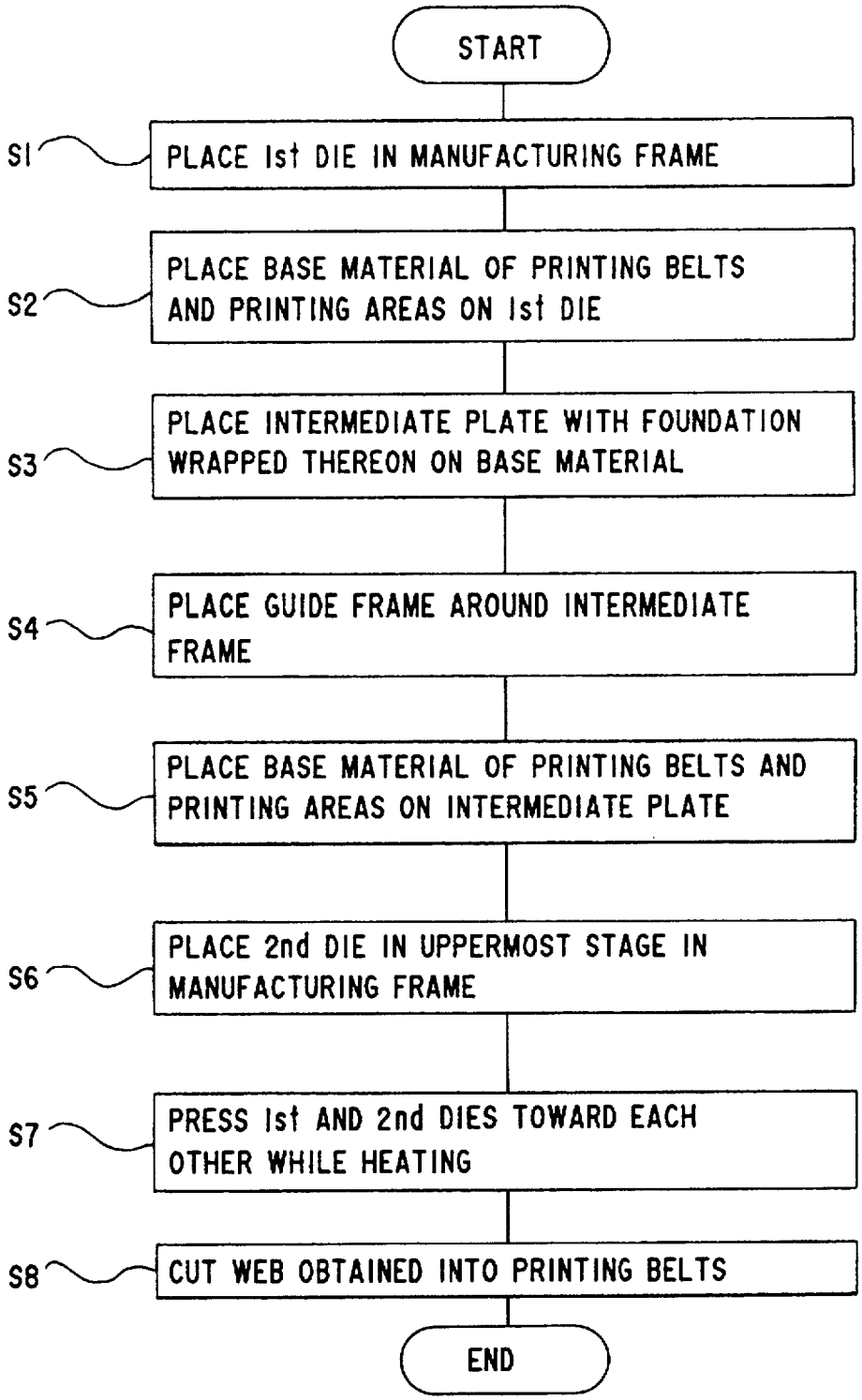
FIG. 22 is a flowchart of a procedure for obtaining the printing belts for use in the rotary stamp of this invention.

A procedure for obtaining the printing belts will be described with reference to the flowchart in FIG. 22 and explanatory views in FIGS. 23A–23C, and 24A–24D.

Figure 23A:
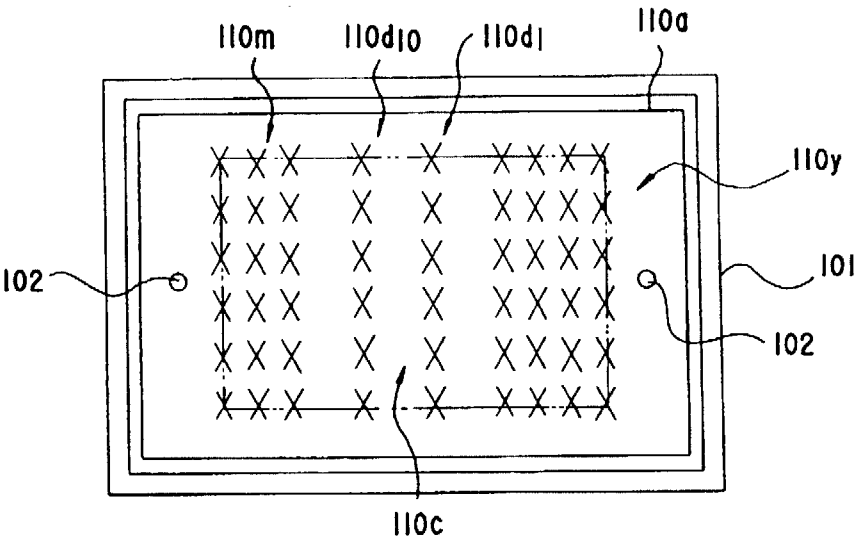
FIGS. 23A–23C and 24A–24D are explanatory views showing the procedure for obtaining the printing belts for use in the rotary stamp of this invention.

Step S1: As shown in FIG. 23A, the first forming die 110*a* is placed in the manufacturing frame 101, with the surface defining the forming recesses 110*c* facing up, and the positioning bores 110*d* penetrated by the rods 102 of the manufacturing frame 101.

Step S2: The sheet-like base material of the printing belts and printing areas is placed on the first forming die 110*a* to be in a position shown in a two-dot-and-dash line in FIG. 23A.

Figure 23B:
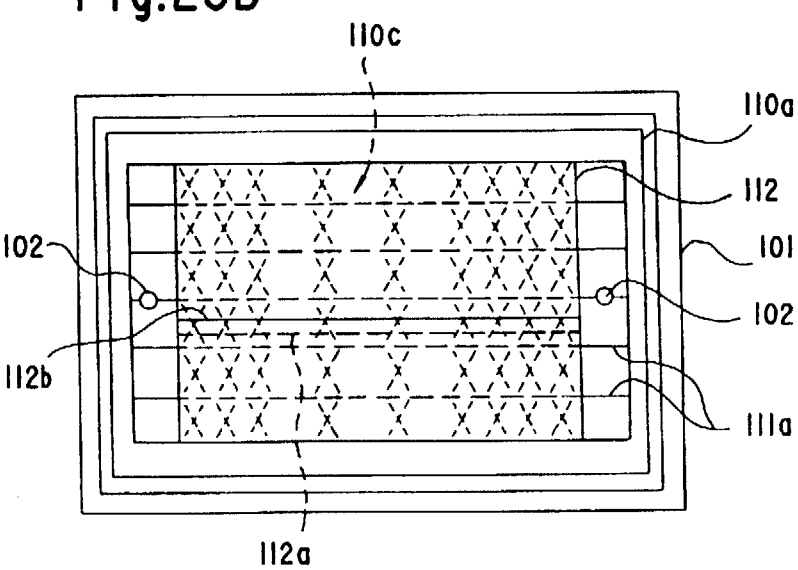

Step S3: As shown in FIG. 23B, the intermediate plate 111 with the foundation 112 wrapped thereon is placed on the sheet-like base material resting on the first forming die 110*a*, with the positioning bores 111*b* of the intermediate plate 111 penetrated by the rods 102 of the manufacturing frame 101. At this time, the overlapping portion of the foundation 112 wrapped around the intermediate plate 111 may be placed facing down and fixedly sandwiched between the sheet-like base material and intermediate plate 111. As shown, the overlapping portion of the foundation 112 wrapped around the intermediate plate 111 may be placed facing up to be fixedly sandwiched between the intermediate plate and the sheet-like base material placed at step S5 to follow.

Figure 23C:
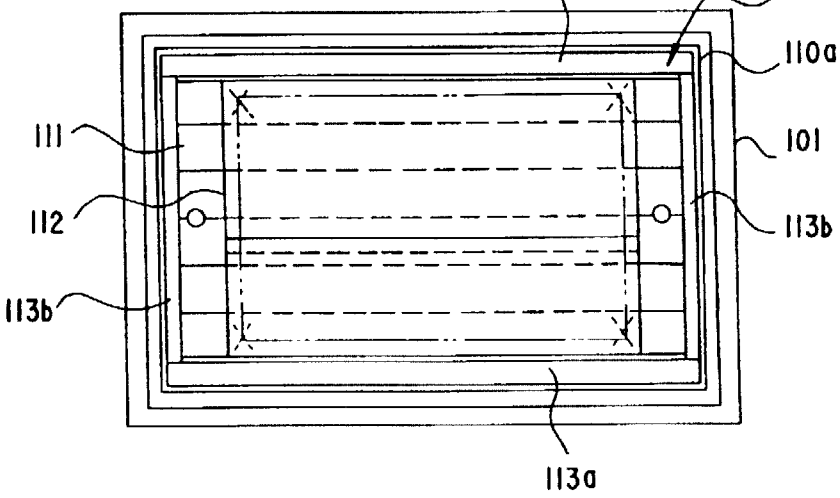
Figure 24B:
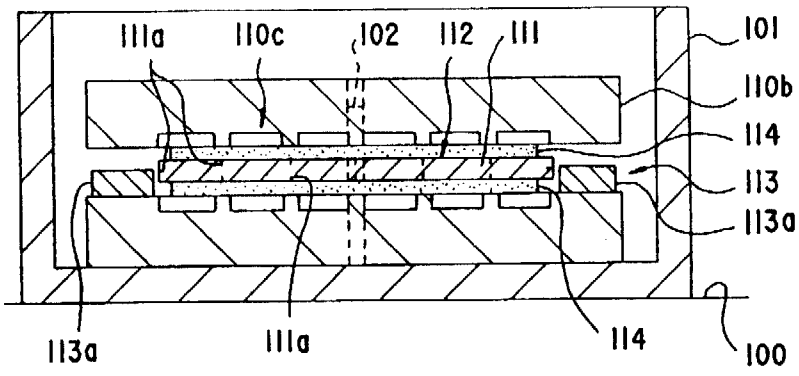

Step S4: As shown in FIG. 23C, the guide frame 113 is placed in the manufacturing frame 101 so as to surround the intermediate plate 111 on which the foundation 112 is wrapped. Consequently, the inner surfaces of the guide members 113*a* of the guide frame 113 are arranged close to the two end surfaces of the intermediate plate 111 where the foundation 112 is wrapped (FIG. 24B). The following measure may be taken to equalize a gap between the inner surface of one of the guide members 113*a* and the end surface of the intermediate plate 111 opposed thereto, and a gap between the inner surface of the other guide member 113*a* and the end surface of the intermediate plate 111 opposed thereto. For example, a plurality of positioning projections (or recesses) are formed on the surface (where the forming recesses 110*c* are formed) of the first forming die 110*a*. A plurality of positioning recesses (projections) are formed on the lower surface of the guide frame 113 for engaging the projections (or the recesses). At step S4, the projections and recesses are engaged to set the guide frame 113 in position relative to the first forming die 110*a*. Since the first forming die 110*a* and intermediate plate 111 are positionally adjusted through the rods 102, the guide frame 113 may be set to a position to equalize the gap between the inner surface of one of the guide members 113*a* and the end surface of the intermediate plate 111 opposed thereto, and the gap between the inner surface of the other guide member 113*a* and the end surface of the intermediate plate 111 opposed thereto.

Step S5: The sheet-like base material of the printing belts and printing areas is placed on the intermediate plate 111 to be in a position shown in a two-dot-and-dash line in FIG. 23C.

Figure 24A:
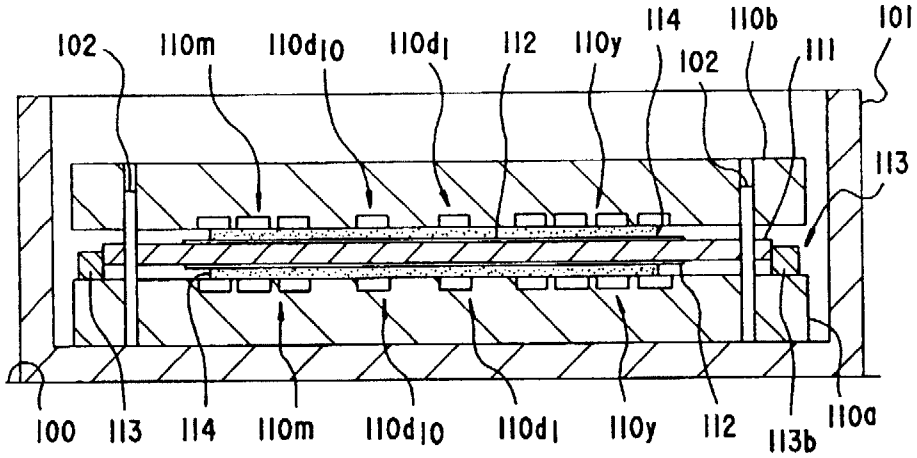

Step S6: The second forming die 110*b* is placed on the sheet-like base material resting on the intermediate plate 111, with the surface of the second forming die 110*b* where the forming recesses 110*c* are formed facing down, and with the positioning bores 110*d* of the second forming die 110*b* penetrated by the rods 102 of the manufacturing frame 101. So far, as shown in FIGS. 24A and 24B, the first forming die 110*a*, sheet-like base material 114 of the printing belts and printing areas, intermediate plate 111 having the foundation 112 wrapped thereon, sheet-like base material 114 for the printing belts and printing areas, and second forming die 110*b* are stacked in the stated order. The inner surfaces of the guide members 113*a* of the guide frame 113 are arranged close to the two end surfaces of the intermediate plate 111 where the foundation 112 is wrapped. As shown in FIG. 24A, the first and second forming dies 110*a* and 110*b* are placed in the manufacturing frame 101, with the columns of the recesses 110*m* for forming the month, the columns of the recesses $\mathbf{110}d_{10}$ for forming the upper digit of the day, the columns of the recesses $\mathbf{110}d_{1}$ for forming the lower digit of the day, and the columns of the recesses 110*y* for forming the year opposed to each other, respectively.

Figure 24D:
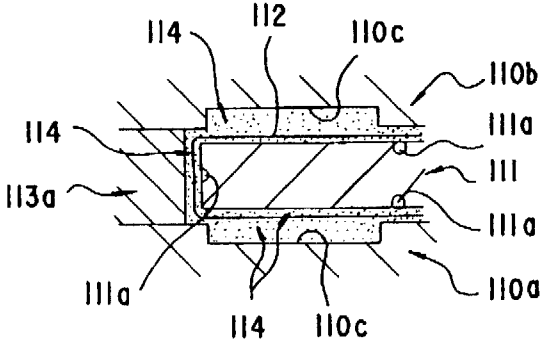
Figure 24C:
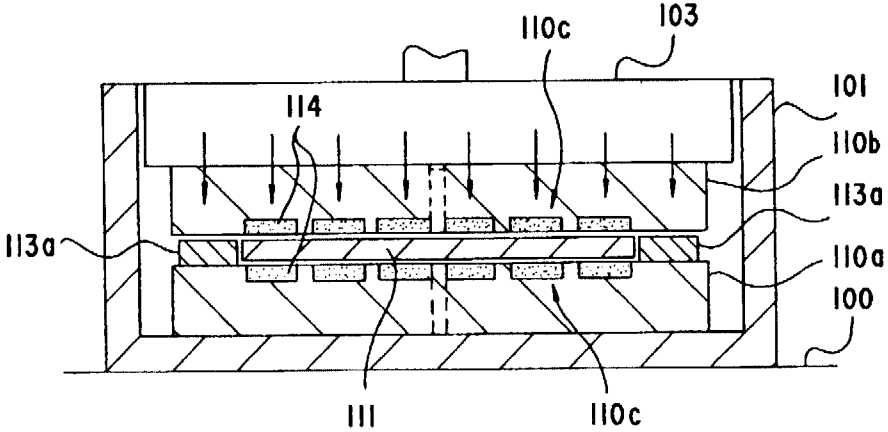

Step S7: The presser 103 is lowered while driving the heaters in the base block 100 and presser 103 to heat the base block 100, manufacturing frame 101 and presser 103. As shown in FIG. 24C, a pressure is applied to press the first forming die 110*a* and second forming die 110*b* toward each other. With this pressurization accompanied by heating, the base material 114 melts and becomes integrated with the foundation 112. As shown in FIG. 24D, the melted base material 114 flows from the upper and lower surfaces of the intermediate plate 111 to the two end surfaces thereof where the foundation 112 is wrapped, to join therewith, thereby forming a web including the intermediate plate 111. The joints may be formed to have a similar thickness to other portions since the guide members 113*a* lie close to the two end surfaces of the intermediate plate 111 having the foundation 112 wrapped thereon. The base material 114 melted during this heating and pressurization flows into the forming recesses 110*c* of the first and second forming dies 110*a* and 110*b* and the grooves 111*a* of the intermediate plate 111. Consequently, the printing areas are formed on the outer surface of the web, and the projections 15 are formed equidistantly on the inner surface thereof.

Figure 25A:
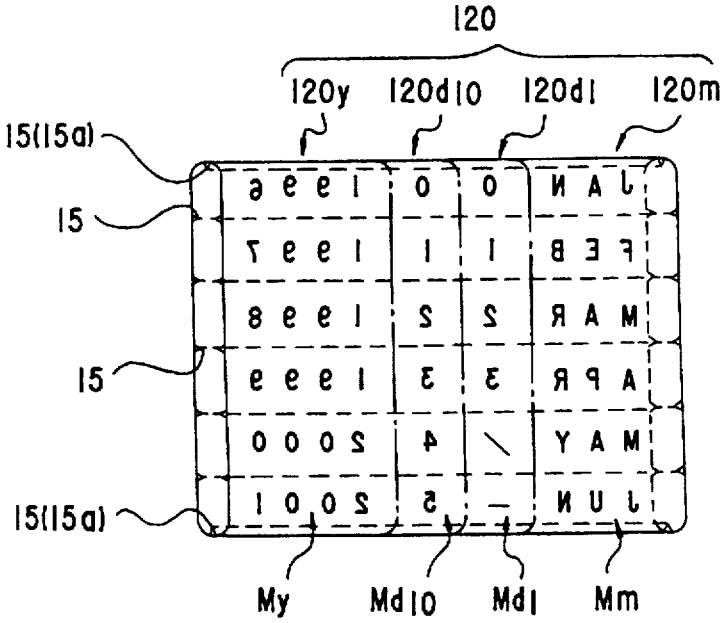
FIG. 25A is a perspective view of a web obtained.
Figure 25B:
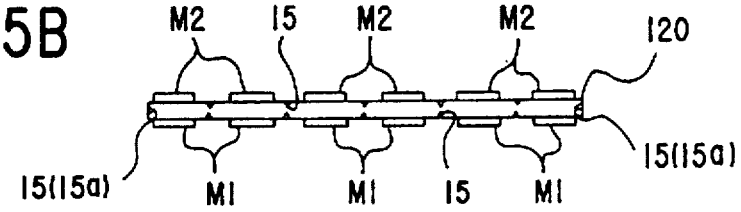
FIG. 25B is a side view of the web obtained.
Figure 25C:
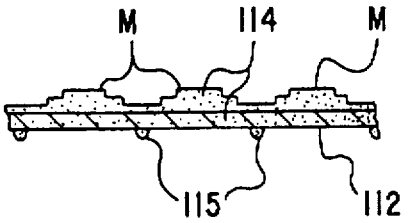
FIG. 25C is an enlarged side view of the web obtained.

Upon lapse of a predetermined time, the heating and pressurization are stopped and the presser 103 is raised. The second forming die 110*b*, intermediate plate 111, and first forming die 110*a* are removed from the manufacturing frame 101. The web integrated with the foundation 112 is separated from intermediate plate 111, and the opposite sides are cut. Thus, web 120 as shown in FIGS. 25A–25C is obtained. The web 120 includes the printing belt 120*y* for the year, printing belt 120$d_1$ for the lower digit of the day, printing belt 120$d_{10}$ for the upper digit of the day, and printing belt 120*m* for the month. These printing belts have, formed on the outer surface thereof, printing areas M (printing areas My for the year, printing areas $Md_1$ for the lower digit of the day, printing areas $Md_{10}$ for the upper digit of the day, and printing areas Mm for the month) with raised typefaces of the printing characters. The printing belts also have projections 15 arranged equidistantly on the inner surfaces thereof. FIG. 25A depicts the printing areas M to be planar. However, as shown in FIGS. 25B and 25C, the printing characters in the respective printing areas M actually have typefaces raised from the outer surfaces. As shown in FIG. 25B, the printing areas M1 formed by the first forming die 110*a* and the printing areas M2 formed by the second forming die 110*b* are consecutively and equidistantly arranged. The ridges 15*a* in the drawings are those formed by the grooves 111*a* in the end surfaces of the intermediate plate 111.

Step S8: Finally, the printing belt 120*y* for the year, printing belt 120$d_1$ for the lower digit of the day, printing belt 120$d_{10}$ for the upper digit of the day, and printing belt 120*m* for the month are cut and separated along dot-and-dash lines in FIG. 25A.

According to the above manufacturing procedure, the web 120 is formed in the heating and pressurizing step for integrating the base material 114 and foundation 112, and forming the printing areas M and projections 15. The printing belts thereby obtained include no unused joints as formed by the conventional manufacturing procedure which superposes and joins the opposite ends of a sheet. The printing areas may be arranged equidistantly. The joints are made by joining the melted base material, which have increased strength. The printing belts obtained are not easily broken. The rotary stamp using such printing belts has an extended life. The web obtained is reinforced with the foundation 112, and the printing belts are stronger than those formed only of rubber or resin, for example. This feature also renders the printing belts difficult to break or become elongated. Moreover, since the web 120 surrounding the intermediate plate 111 is formed according to the above manufacturing method, it is always possible to form printing belts having a length in the rotating direction corresponding to the circumferential length of the intermediate plate 111. The printing belts obtained always have a correct length in the rotating direction as designed.

Next, a procedure for manufacturing the display belts will be described with reference to FIGS. 26A, 26B and 27.

The procedure for manufacturing the display belts is basically the same as the printing belt manufacturing procedure described above, but the printing areas are unnecessary to the display belts. Thus, a first and second display belt forming dies 115*a* and 115*b* are used in place of the first and second printing belt forming dies 110*a* and 110*b*. The first and second display belt forming dies 115*a* and 115*b* have no forming recesses 110*c* in the surfaces thereof opposed to the intermediate plate. These surfaces are planar, for example.

Figure 26A:
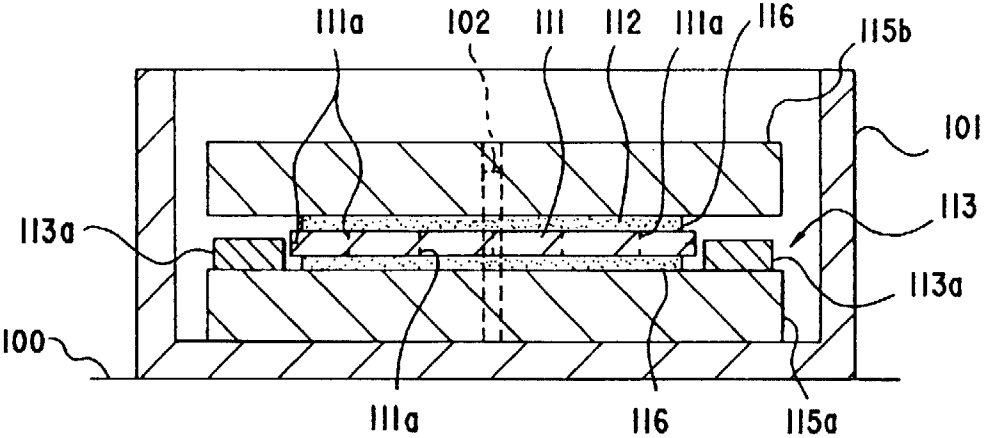
FIGS. 26A and 26B are explanatory views showing a procedure for obtaining display belts for use in the rotary stamp of this invention.
Figure 26B:
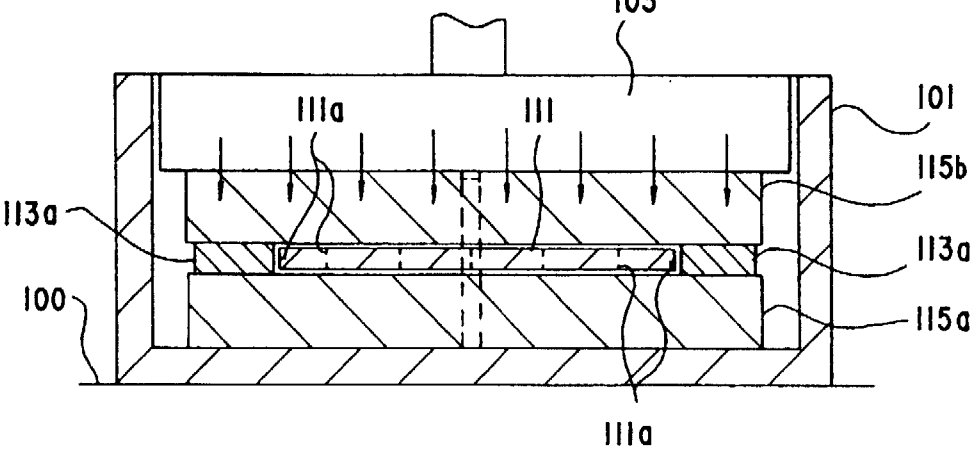

As shown in FIG. 26A, the first display belt forming die 115*a*, a sheet-like rubber or resin base material 116 for the display belts, an intermediate plate 111 having a foundation 112 wrapped thereon, sheet-like base material 116 for the display belts, and the second display belt forming die 110*b* are stacked in the stated order in the manufacturing frame 101. The inner surfaces of the guide members 113*a* of the guide frame 113 are arranged close to the two end surfaces of the intermediate plate 111 where the foundation 112 is wrapped. As shown in FIG. 26B, the presser 103 is lowered to press, while heating, the first forming die 115*a* and second forming die 115*b* toward each other.

Figure 27:
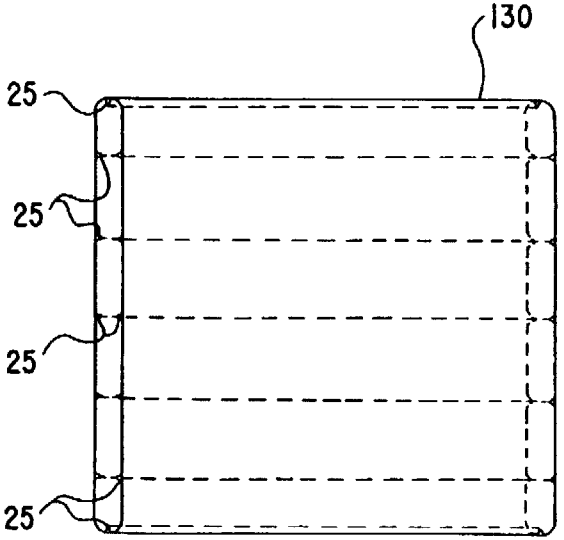
FIG. 27 is a perspective view showing a web for forming the display belts.

As in the case of the web 120 for the printing belts, the base material 116 becomes integrated with the foundation 112 to provide a web 130 having projections 25 arranged equidistantly on the inner surface thereof as shown in FIG. 27. This web 130 has a planar outer surface.

The web 130 is cut to predetermined widths, and display tapes or the like having printed thereon the display characters in normal character form corresponding to the printing characters of the printing areas M (My, $Md_1$, $Md_{10}$ and Mm) formed on the printing belts 120*y*, 120$d_1$,120$d_{10}$ and 120*m* are applied thereto. Thus, display belts corresponding to the printing belts 120*y*, 120$d_1$,120$d_{10}$ and 120*m* are obtained.

The display belts include no unused joints as do the printing belts, and are difficult to break or become elongated. The display belts obtained always have a correct length in the rotating direction as designed.

In the stamps 1 and 60 in the first and third embodiments, the display belts must be rotated synchronously with the printing belts to show, through the display window 5, the display characters corresponding to the printing characters in the printing areas M set to the printing opening 6. If, for example, either the printing belts or the display belts have a length in the rotating direction deviating from design, then the display characters displayed in the display window 5 become displaced from the printing characters in the printing areas M set to the printing opening 6 while rotating the printing belts and display belts.

The printing belts and display belts obtained from the foregoing procedure always have lengths in the rotating directions as designed. (For example, the printing belts may have the same length in the rotating direction as the display belts.) This avoids the inconvenience of the display characters displayed in the display window 5 becoming displaced from the printing characters in the printing areas M set to the printing opening 6.

In the procedure for manufacturing the printing belts described above, a web having a plurality of printing belts is manufactured. Only one type of printing belts may be obtained by using a first and a second dies designed to form the one type of printing belts. A plural sets of first forming dies, base materials of the web, intermediate plates having foundations wrapped thereon, base materials of the web and the second forming dies with a plurality of guide frames may be arranged side by side in the manufacturing frame, and heated and pressed by the presser 103, to obtain a plurality of webs simultaneously. Such an operation provides increased productivity. This modification is applicable to the manufacture of the display belts also.

In the foregoing embodiments, the grooves 111*a* are arranged equidistantly in the intermediate plate 111 to form the projections 15. An intermediate plate 111 having no such forming grooves may be used when the projections 15 are unnecessary to the printing belts and display belts.

The present invention may be embodied in other specific forms without departing from the spirit or essential attributes thereof and, accordingly, reference should be made to the appended claims, rather than to the foregoing specification, as indicating the scope of the invention.

What is claimed is:

1. A rotary stamp having endless printing belts with plural types of printing areas arranged on outer surfaces thereof, the printing belts being rotatable to set printing surfaces of selected printing areas to a printing position, said rotary stamp comprising:

at least one printing rotation member;

at least one printing support shaft;

a printing rotation unit including at least one set of said at least one printing rotation member opposed to said at least one printing support shaft, and an endless printing belt wound around said printing support shaft and said printing rotation member, said endless printing belt having plural types of printing areas arranged on an outer surface thereof;

a display rotation unit including at least one display rotation mechanism having, arranged on an outer surface thereof, display characters corresponding to printing characters in said printing areas arranged on said outer surface of said printing belt, wherein said display rotation mechanism includes a display rotation member;

a display support shaft opposed to said display rotation member; and an endless display belt wound around said display rotation member and said display support shaft and having, arranged on an outer surface thereof, said display characters corresponding to said printing characters in said printing areas;

at least one control member for applying torque to said printing rotation member or said display rotation mechanism; and at least one synchronous rotation means for synchronously rotating said printing rotation member and said display rotation mechanism with said torque applied by said control member, such that said printing rotation member is rotated to set said printing surfaces of said printing areas successively to said printing position adjacent said printing support shaft, and said display rotation mechanism is rotated to set, to a display position, display characters corresponding to said printing characters in said printing areas set to said printing position.

2. A rotary stamp as defined in claim 1, wherein each of said printing rotation members comprise one or more connectable and separable roller elements.

3. A rotary stamp as defined in claim 1, wherein each of said printing support shafts comprise one or more connectable and separable roller elements.

4. A rotary stamp as defined in claim 1, wherein said printing support shaft and said display support shaft comprise rotatable square shafts.

5. A rotary stamp as defined in claim 1, wherein said printing rotation unit is mounted in a housing defining a printing opening for exposing said printing surface of said printing area set to said printing position, with at least part of said control member protruding outwardly of said housing.

6. A rotary stamp as defined in claim 1, wherein said display rotation unit is mounted in a housing defining a display window having a convex lens fitted therein for magnifying and displaying display characters set to said display position, with at least part of said control member protruding outwardly of said housing.

7. A rotary stamp as defined in claim 6, wherein at least a portion of said housing opposed to said outer surface of the display rotation mechanism is formed of a transparent material.

8. A rotary stamp as defined in claim 1 wherein each of said display rotation members comprise one or more connectable and separable roller elements.

9. A rotary stamp as defined in claim 1 wherein each of said display support shafts comprise one or more connectable and separable roller elements.

10. A rotary stamp as defined in claim 1, wherein said rotary stamp comprises a penetration type stamp having said printing areas formed of a porous material, and an ink supply mechanism for supplying ink to said printing areas.

11. A rotary stamp as defined in claim 10, wherein said ink supply mechanism comprises tubular members forming said printing rotation member and said printing support shaft, with peripheral portions thereof formed of a porous material, for supplying ink contained in said tubular members to said printing areas through said peripheral portions formed of said porous material.

12. A rotary stamp as defined in claim 10, wherein said ink supply mechanism includes at least one ink absorber arranged to contact the printing surface of at least one printing area.

13. A rotary stamp as defined in claim 12, wherein said ink absorber is arranged to contact at least the printing surface of the printing area set to said printing position, and printing surfaces of preceding and succeeding printing areas.

14. A rotary stamp as defined in claim 1, wherein said printing belt wound around said printing support shaft and said printing rotation member comprises a web formed by stacking a first printing belt forming die, a base material of said printing belt and said printing areas, an intermediate plate having a foundation wrapped thereon, a base material of said printing belt and said printing areas and a second printing belt forming die in the stated order, placing a guide member adjacent two end surfaces of said intermediate plate where said foundation is wrapped, and applying a pressure to move said first forming die and said second forming die toward each other while heating said first forming die and said second forming die.

15. A rotary stamp as defined in claim 1, wherein said printing belt wound around said printing support shaft and said printing rotation member comprises a web formed by stacking a first printing belt forming die, a base material of said printing belt and said printing areas, an intermediate plate having a foundation wrapped thereon, a base material of said printing belt and said printing areas and a second printing belt forming die in the stated order, placing a guide member adjacent two end surfaces of said intermediate plate where said foundation is wrapped, and applying a pressure to move said first forming die and said second forming die toward each other while heating said first forming die and said second forming die; and said display belt wound around said display support shaft and said display rotation member comprises a web formed by stacking a first display belt forming die, a base material of said display belt, an intermediate plate having a foundation wrapped thereon, a base material of said display belt and a second display belt forming die in the stated order, placing a guide member adjacent two end surfaces of said intermediate plate where said foundation is wrapped, and applying a pressure to move said first forming die and said second forming die toward each other while heating said first forming die and said second forming die.

16. A rotary stamp as defined in claim 1 wherein each of said printing rotation members and said display rotation members define recesses arranged at fixed intervals on an outer surface thereof, and each of said printing belts and said display belts define ridges arranged at fixed intervals on an inner surface thereof for engaging said recesses of said rotation members.

17. A rotary stamp as defined in claim 16, wherein said printing belt wound around said printing support shaft and said printing rotation member comprises a web formed by stacking a first printing belt forming die, a base material of said printing belt and said printing areas, an intermediate plate having a foundation wrapped thereon, said intermediate plate defining a plurality of grooves for forming said ridges, arranged on peripheral surfaces thereof including two end surfaces on which said foundation is wrapped, at fixed intervals along a direction in which said foundation is wrapped, a base material of said printing belt and said printing areas and a second printing belt forming die in the stated order, placing a guide member adjacent said two end surfaces of said intermediate plate where said foundation is wrapped, and applying a pressure to move said first forming die and said second forming die toward each other while heating said first forming die and said second forming die; and said display belt wound around said display support shaft and said display rotation member comprises a web formed by stacking a first display belt forming die, a base material of said display belt, an intermediate plate having a foundation wrapped thereon, said intermediate plate defining a plurality of grooves for forming said ridges, arranged on peripheral surfaces thereof including two end surfaces on which said foundation is wrapped, at fixed intervals along a direction in which said foundation is wrapped, a base material of said display belt and a second display belt forming die in the stated order, placing a guide member adjacent said two end surfaces of said intermediate plate where said foundation is wrapped, and applying a pressure to move said first forming die and said second forming die toward each other while heating said first forming die and said second forming die.

18. A rotary stamp as defined in claim 1 wherein each of said printing rotation members and said display rotation members define ridges arranged at fixed intervals on an outer surface thereof, and each of said printing belts and said display belts define recesses arranged at fixed intervals on an inner surface thereof for engaging said ridges of said rotation members.

* * * * *